US011034541B2

(12) United States Patent
Mencarini et al.

(10) Patent No.: US 11,034,541 B2
(45) Date of Patent: Jun. 15, 2021

(54) FOLDING ROLLER AND INTERFOLDING MACHINE EMPLOYING SAID ROLLER

(71) Applicant: MTORRES TISSUE S.R.L., Lucca (IT)

(72) Inventors: Luca Mencarini, Lucca (IT); Daniele Dettori, Capannori (IT); Andrea Arrighini, Viareggio (IT)

(73) Assignee: MAXIMA S.R.L.

( * ) Notice: Subject to any disclaimer, the term of this patent is extended or adjusted under 35 U.S.C. 154(b) by 230 days.

(21) Appl. No.: 16/320,298

(22) PCT Filed: Jul. 19, 2017

(86) PCT No.: PCT/EP2017/068253
§ 371 (c)(1),
(2) Date: Jan. 24, 2019

(87) PCT Pub. No.: WO2018/019679
PCT Pub. Date: Feb. 1, 2018

(65) Prior Publication Data

US 2019/0270609 A1 Sep. 5, 2019

(30) Foreign Application Priority Data

Jul. 25, 2016 (IT) ..... 10201600077916

(51) Int. Cl.
*B65H 45/24* (2006.01)
*B31D 1/04* (2006.01)
*B65H 45/28* (2006.01)

(52) U.S. Cl.
CPC ..... *B65H 45/24* (2013.01); *B31D 1/04* (2013.01); *B65H 45/28* (2013.01);
(Continued)

(58) Field of Classification Search
CPC .. B65H 45/24; B65H 45/28; B65H 2406/332; B65H 2406/3614; B65H 2406/363; B65H 2701/1924; B31D 1/04
See application file for complete search history.

(56) References Cited

U.S. PATENT DOCUMENTS 4,778,441 A * 10/1988 Couturier ..... B65H 45/24 270/39.06
5,000,729 A * 3/1991 Yamauchi ..... B65H 45/24 493/359

(Continued)

FOREIGN PATENT DOCUMENTS

CN 102 009 869 A 4/2011
CN 102431833 A * 10/2011 ..... B65H 45/24

(Continued)

OTHER PUBLICATIONS

International Search Report, PCT/EP2017/068253, dated Oct. 9, 2017, 3 pages.

(Continued)

*Primary Examiner* — Andrew M Tecco
*Assistant Examiner* — Nicholas E Igbokwe
(74) *Attorney, Agent, or Firm* — Ware, Fressola, Maguire & Barber LLP

(57) ABSTRACT

An interfolding machine (1) is described, including folding rollers (3). Such a roller has a cylindrical sleeve (3C) having a rotation axis (3A), an outer surface (3X) and an inner surface (3Y) defining an inner axial cavity (23) of the cylindrical sleeve (3C). The cylindrical sleeve includes, furthermore, a plurality of suction holes (41, 43) which extend from the outer surface (3X) to the inner surface (3Y) of the cylindrical sleeve (3C). The suction holes are arranged depending on longitudinal alignments (42, 44), parallel to the rotation axis (3A) of the cylindrical sleeve (3C) and angularly staggered in relation to one another. Inside a (Continued)

suction chamber (23A) in the cylindrical sleeve (3C), shutters are stationarily arranged having closing surfaces (37A) cooperating with the inner surface (3Y) of the cylindrical sleeve (3C) to selectively close the suction holes.

18 Claims, 16 Drawing Sheets

(52) U.S. Cl.
CPC .. *B65H 2406/332* (2013.01); *B65H 2406/363* (2013.01); *B65H 2406/3614* (2013.01); *B65H 2701/1924* (2013.01)

(56) References Cited

U.S. PATENT DOCUMENTS

| | | | | |
|---|---|---|---|---|
| 6,228,014 | B1 | 5/2001 | De Matteis et al. | |
| 7,097,607 | B2 | 8/2006 | De Matteis | |
| 7,517,309 | B2 | 8/2009 | De Matteis | |
| 2004/0159999 | A1* | 8/2004 | Dematteis | B65H 45/28 271/264 |
| 2012/0065045 | A1* | 3/2012 | De Matteis | B65H 27/00 493/442 |
| 2012/0068401 | A1 | 3/2012 | Kondo | |

FOREIGN PATENT DOCUMENTS

| | | | |
|---|---|---|---|
| EP | 1 457 444 | A2 | 9/2004 |
| WO | 1991/019613 | A1 | 12/1991 |

OTHER PUBLICATIONS

Written Opinion of the ISA, PCT/EP2017/068253, dated Oct. 9, 2017, 5 pages.

* cited by examiner

FOLDING ROLLER AND INTERFOLDING MACHINE EMPLOYING SAID ROLLER

TECHNICAL FIELD

The present invention relates to the field of paper converting machines, in particular of the so called tissue paper converting machines, to produce handkerchiefs, napkins or the like. Embodiments described below relate to interfolding machines and to components for said machines.

BACKGROUND ART

In the field of tissue paper conversion, there are known machines, so called interfolding machines, to divide a continuous web material into single sheets which are bended and then folded over one another. Examples of interfolding machines are described in U.S. Pat. Nos. 6,228,014, 7,097,607, 7,517,309, WO2004/071921, EP1457444 and in prior documents cited in the aforesaid publications.

The interfolding machines have a couple of folding rollers placed side by side and with parallel axes, among which is defined a folding nip. Each folding roller receives cut ribbon-shaped material sheets, which are bended and folded in the folding nip. Complex suction systems are used to manage the passage of the borders of the single sheets from a roller to another in the folding nip. The activation and the interruption of the suction must be timely to allow a fast working of the interfolding machine.

This requires the need of complex opening and closure means of suction valves. Despite all the efforts dedicated to the development of these machines, the inertia existing in the pneumatic circuits inside the folding rollers create serious problems and set limits to the operating speed of the machines. Moreover, the control mechanisms of activation and interruption of the suction are complicated and subject to breakdowns.

The level of technological complexity needed to manufacture the aforesaid rollers is expensive and requires a high degree of specialization.

A further drawback of the known rollers is high power consumption, both to activate and deactivate the suction flows with continuous inertias.

There is therefore the need to realize folding rollers and interfolding machines employing such rollers which overcome in whole or in part the limits of the traditional machines.

DISCLOSURE OF INVENTION

According to a first point of view, a folding roller is shown comprising a cylindrical sleeve having a rotation axis, an outer surface and an inner surface defining an axial cavity of the cylindrical sleeve. The folding roller comprises, furthermore, an inner body which axially develops in the axial cavity which is inside the cylindrical sleeve, which is arranged to rotate around the inner body.

Furthermore, a suction chamber inside the cylindrical sleeve and a plurality of suction holes are provided, such holes extending from the outer surface to the inner surface of the cylindrical sleeve.

The suction holes are arranged with longitudinal alignments, nearly or substantially parallel to the rotation axis of the cylindrical sleeve and angularly staggered one another.

According to embodiments described below, inside the suction chamber is arranged a plurality of stationary shutters, for example integral with the inner body, with a closing surface which cooperates with the inner surface of the cylindrical sleeve, such closing surface being shaped and arranged to close the suction holes which, during the rotation movement of the cylindrical sleeve around the rotation axis, pass in front of the shutter.

For stationary shutters are meant shutters not rotating with the rotating cylindrical sleeve of the folding roller during operation in normal conditions of the folding roller.

By means of the plurality of shutters, spaced and aligned one another along the rotation axis of the cylindrical sleeve of the roller, it is possible to selectively close the holes of some longitudinal alignments of suction holes, leaving the holes of other longitudinal alignments opened.

In particular, this way it is possible, by means of use of the only shutters, to maintain the suction alive through some longitudinal alignments for a rotation angle, along which, vice versa, the suction is interrupted through other longitudinal alignments.

Advantageously, the suction holes can be arranged with circumferential alignments. Each shutter also has circular arc shape for an appropriate angle, determined on the basis of the activation and deactivation phases of the suction through the opening.

To obtain selective opening and closure of the different alignments of the suction holes, it is possible to provide that the suction holes of at least a first longitudinal alignment are arranged along circumferential lines coinciding with the position of the shutters. Vice versa, the suction holes of at least a second longitudinal alignment are arranged along circumferential lines which are interposed between adjacent shutters.

This way, while the cylindrical sleeve rotates around its own axis, the suction holes of the first longitudinal alignment are closed, i.e. they are closed by the shutters, while the holes of the second longitudinal alignment are not closed by the shutters. Consequently, along the angle corresponding to the arc along which the shutters develop, the suction holes of the first alignment don't suck, while the suction holes of the second alignment suck, being arranged in flow communication with the suction chamber in which are situated the shutters.

In other embodiments, rather than using a stagger in axial direction of the suction holes, so that they are selectively partially closed by the shutters and partially they remain opened, it is possible to provide that the suction holes have a suitable shape. For example, it is possible to make the suction holes, whose suction must not be interrupted by the shutters, shorter, realizing for example hollows or longitudinal grooves on the inner surface of the cylindrical sleeve.

In correspondence with the hollows or grooves there are entrances of the suction holes which must not be closed by the shutters. The distance between shutters and inner surface of the cylindrical sleeve in the grooves or longitudinal hollows area ensures the shutters not to close the suction holes.

After all, with the arrangement according to the invention we obtain a suction roller or folding roller in which, with simple, reliable and easy to make means, it is possible to activate and deactivate the suction through suction holes selectively during rotation of the cylindrical sleeve of the folding roller, so that along at least a rotation angle the suction is activate through the suction holes of a first set, while it is deactivate through the suction holes of a second set.

Depending on the radial dimension of the folding roller it is possible to provide a number of longitudinal alignments of suction holes higher than two. In such event, it is advantageously provided that the longitudinal alignments are split in two groups, interposed one another, so that each longitudinal alignment of suction holes belonging to a first set of suction holes is located between two longitudinal alignments of suction holes of the other set of suction holes.

According to another aspect, it is described an interfolding machine comprising a couple of folding rollers as described, disposed with respective rotation axis nearly parallel to one another and put near each other to form a folding nip.

Further advantageous features and possible embodiments of the folding roller and the interfolding machine are described below with reference to the enclosed drawings and are defined in the enclosed claims.

BRIEF DESCRIPTION OF THE DRAWINGS

The enclosed drawings show an illustrative embodiment of a folding machine according to the invention. Figures are not necessarily drawn to scale. More particularly, in the enclosed drawings.

DETAILED DESCRIPTION OF THE INVENTION

Figure 1:
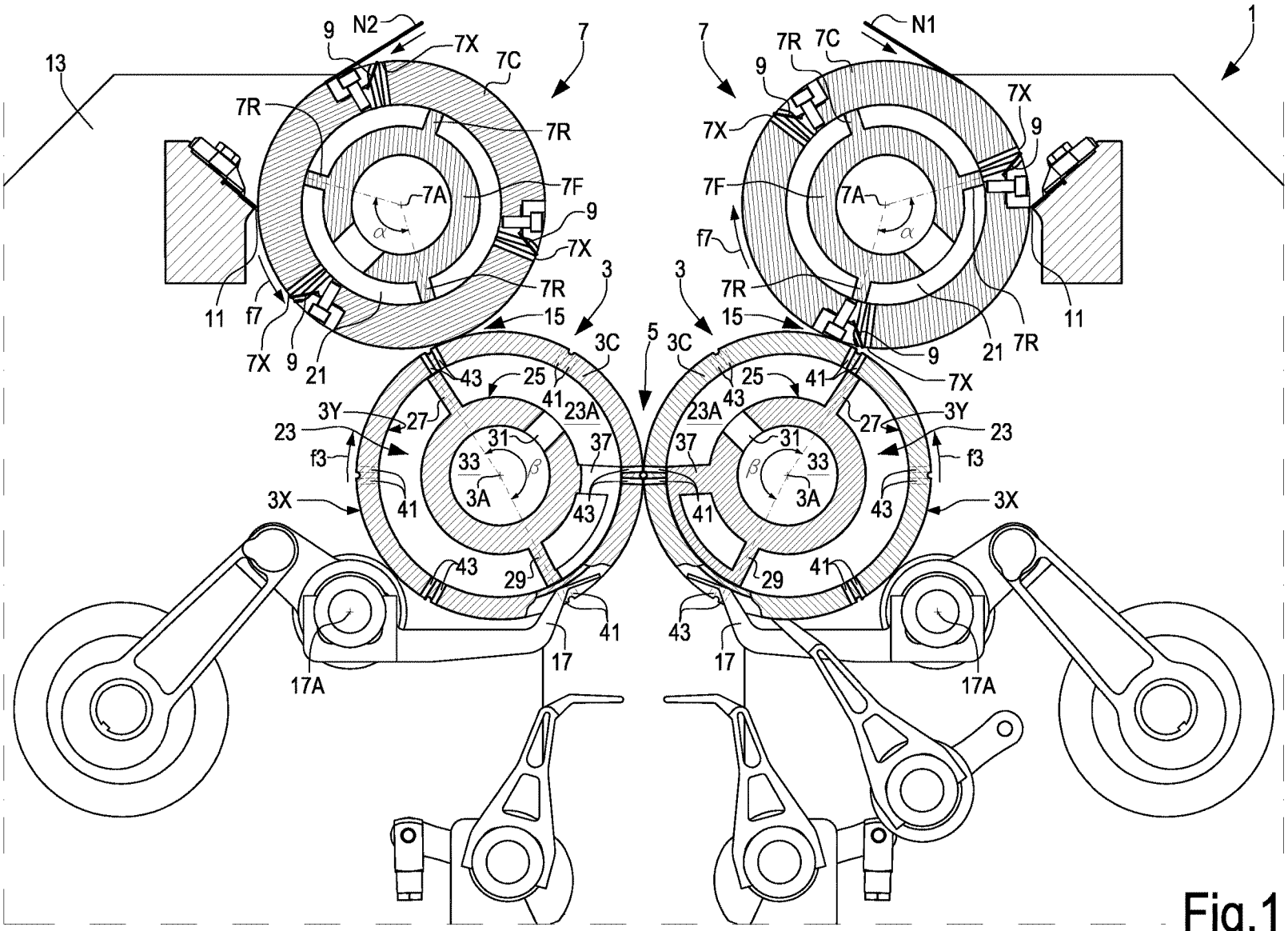
FIG. 1 illustrates a schematic section of an interfolding machine, according to a plane which is orthogonal to the rotation axis of the folding and cutting rollers of the interfolding machine.

With initial reference to FIG. 1, Numeral 1 generically indicates an interfolding machine which can comprise a couple of folding rollers 3 each rotating around a respective rotation axis 3A, substantially parallel to one another. Between the folding rollers 3 is defined a folding nip 5.

In the embodiment illustrated in FIG. 1, each folding roller 3 cooperates with a respective cutting roller 7 equipped with a plurality of cutting blades 9. In the illustrated embodiment, each cutting roller 7 has three cutting blades 9, spaced apart from one another by 120°. The cutting rollers 7 rotate around a respective rotation axis 7A, parallel to one another and substantially parallel to the rotation axis 3A of the folding rollers 3.

The number of cutting blades is illustrative and non-limitative. In other embodiments can be provided blades in a number different from three. Generally, it is provided a plurality of blades 9 spaced apart from one another by a substantially constant angular step around the cylindrical surface of the respective cutting roller 7.

The blades 9 of each cutting roller 7 cooperate with a respective stationary counter-blade 11, supported on a bearing structure 13 of the interfolding machine 1. Each cutting roller 7 defines, together with the respective folding roller 3, a transfer nip 15.

To each cutting roller 7 a respective continuous web material is provided, schematically indicated with N1 and N2 in FIG. 1, for the two cutting rollers 7. The two web materials are cut in single sheets by the cutting rollers 7 cooperating with the counter-blades 11. The single sheets carried out by the cutting are transferred to the folding rollers 3 and bended and folded by means of the folding rollers 3 as described below in more detail.

Each folding roller 3 cooperates with a respective removing comb 17, that provides for removing the bended sheets from the folding rollers 3 to stack them in the area below the folding nip 5. The folded sheets form piles of a predetermined number of sheets which are then directed to a packing machine, not shown.

Figure 2:
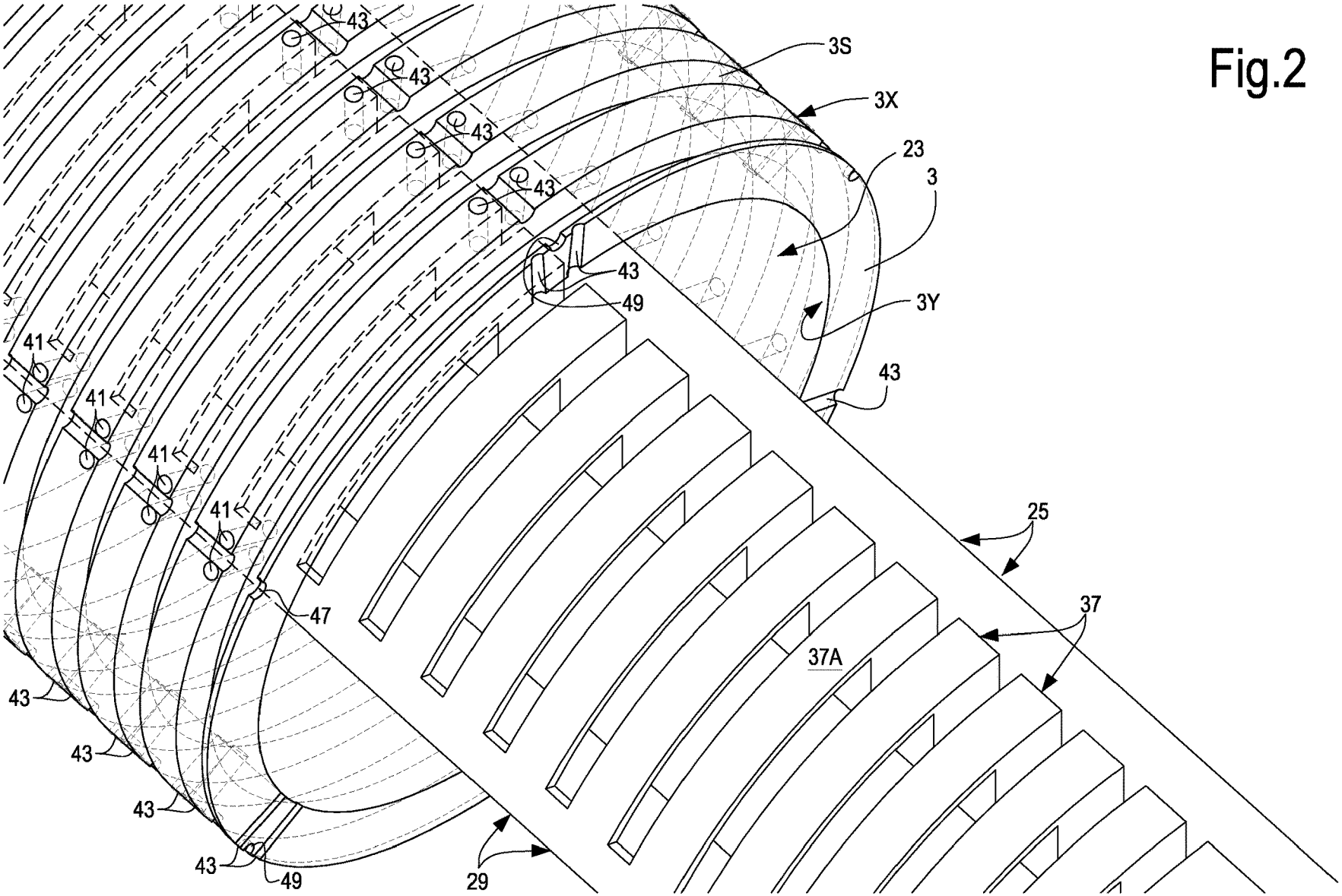
FIG. 2 illustrates a broken axonometric view of one of the folding rollers of the interfolding machine of FIG. 1.
Figure 3:
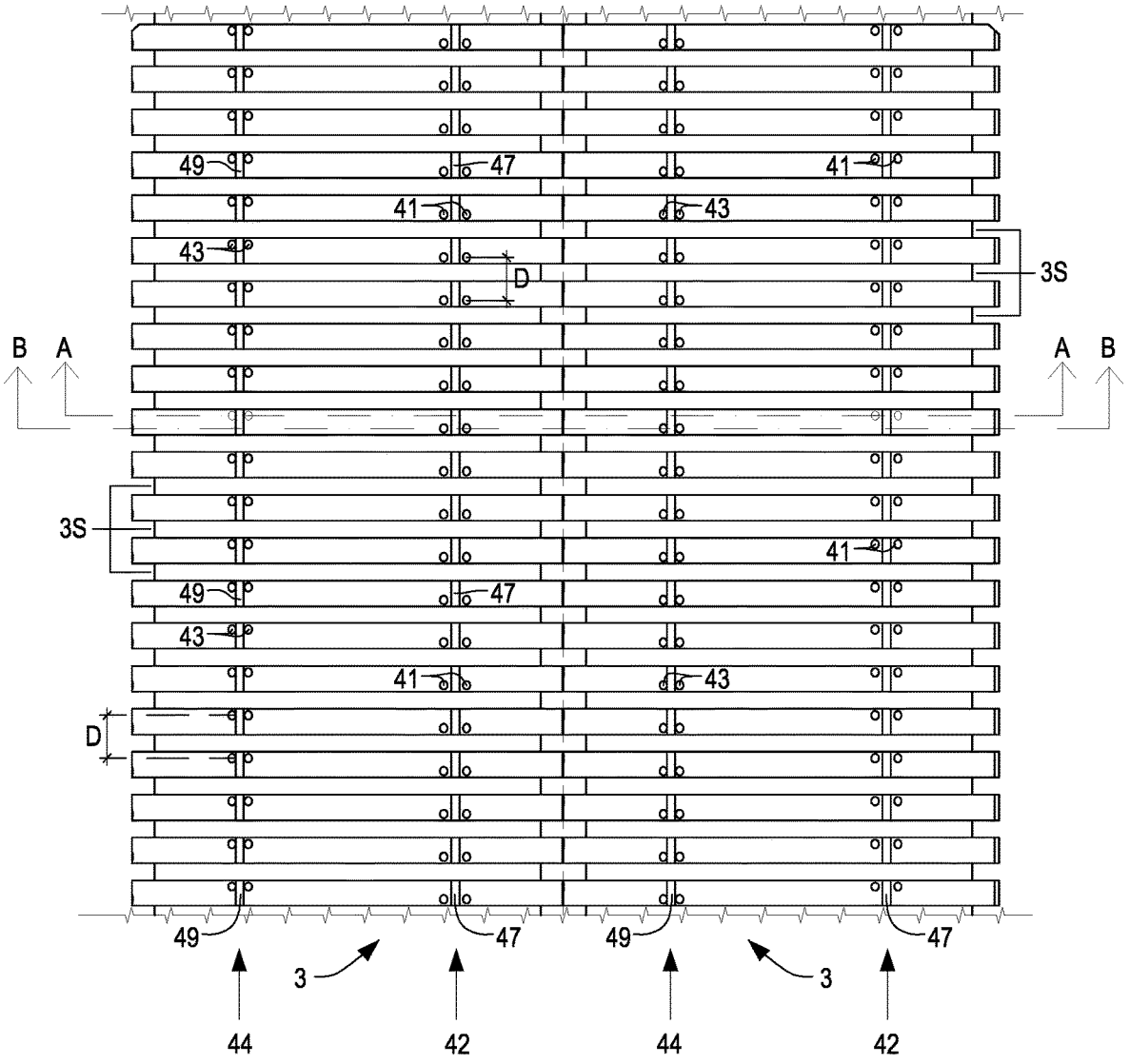
FIG. 3 illustrates a partial and top view of the two folding rollers of FIG. 2.

The folding rollers 3 are externally grooved as evident in particular in FIGS. 2 and 3. In the annular grooves, indicated with 3S, of the two folding rollers 3 are housed the ends of the respective removing combs 17 which oscillate around respective rotation axes 17A.

The cutting rollers 7 have an external cylinder liner 7C which rotates according to the respective arrows f7 around the axes 7A. Inside the cylinder liners 7C there are fixed hollow elements 7F, which form, by means of radial walls 7R, a respective suction chamber 21.

The suction chamber 21 of each cutting roller 7 develops from a feeding area to the respective cutting roller 7 of the web material N1, N2, up to a position almost corresponding to the transfer nip 15.

The cylindrical sleeve or liner 7C has radial suction holes 7X which cross the thickness of the cylinder liner 7C and are situated near the blades 9. The radial suction holes 7X connect the external surface of the cylinder liner 7C of each cutting roller 7 with the respective suction chamber 21.

This way, when the holes 7X are in the range of action of the suction chamber 21, along the angle $\alpha$, through the radial suction holes 7X, a suction action of the web material N1, N2 is generated.

The suction keeps the web material very near the blades 9, where the web material N1, N2 is cut to form single sheets of web material to bend and fold in the described way.

The structure of the folding rollers 3 is now described in details with specific reference to FIGS. 1-3.

Each folding roller 3 has an external cylindrical sleeve 3C, rotating around an axis 3A of the respective folding roller. The cylindrical sleeve 3C comprises an outer surface 3X and an inner surface 3Y. The inner surface 3Y defines an axial cavity 23 inside the cylindrical sleeve 3C, which extends parallel to the longitudinal axis or rotation axis 3A of the respective folding roller 3.

In the axial cavity 23 of the folding roller 3 there is an inner body 25 which, during the operation of the interfolding machine 1, remains substantially fixed, i.e. stationary with respect to the bearing structure 13. In some embodiments the angular position of the inner body 25 can be adjusted for a fine registration of the operation of the roller and of the machine to which the folding roller 3 belongs.

The registration can occur with a manual or servo-assisted system, not shown. The inner body 25 can for this purpose have end means, not shown, which protrude from the folding roller 3 and which are mounted into supports of the interfolding machine 1, on which can eventually act angular registration members.

The inner body has two radial walls 27, 29 which radially extend up to the inner surface 3Y of the cylindrical sleeve 3C. The edges of the radial walls 27, 29 can be equipped with gaskets, not shown, which cooperate with the inner surface 3Y of the cylindrical sleeve 3C of the respective folding roller 3.

In the illustrated embodiment the two radial walls 27, 29 are angularly staggered with respect to each other at an angle β slightly higher than 180°, e.g. around 190°.

In some embodiments the angle β can be different. The possibility that the angle β is recordable is not excluded. The radial wall 27 is slightly upstream of the transfer nip 15 with respect to the rotation direction f3 of the cylindrical sleeve 3C.

The radial wall 29 is, vice versa, substantially downstream of the folding nip 5 with respect to the rotation direction f3 of the cylindrical sleeve 3C. More exactly, the radial wall 29 is nearly located in the action area of the respective removing comb 17.

Between the two radial walls 27, 29 of each folding roller 3, on the side facing the folding nip 5, is defined a suction chamber 23A, which takes up the portion of the cavity 23 inside its folding roller 3 delimited by the inner body 25, by its radial walls 27, 29 and by the inner surface 3Y of the cylindrical sleeve 3C. The suction chamber 23A is in fluid communication, through openings 31 carried out in the inner body 25, with a suction volume 33 axially carried out into the inner body 25. The suction volume 33 is permanently engaged with a suction line, not shown, e.g. through one or both the ends of the respective folding roller 3.

Shutters 37 are integral with the inner body 25, such shutters being comb-shaped better represented in the axonometric broken view of FIG. 2. As it can be observed, in FIG. 2 the shutters 37 are parallel and spaced from one another forming a comb structure.

Each shutter 37 has an arched, radially external closing surface 37A, having a substantially cylindrical shape, with a bend radius corresponding to the bend radius of the inner surface 3Y of the cylindrical sleeve 3C. The closing surface 37A of each shutter 37 substantially touches the inner surface 3Y of the cylindrical sleeve 3C, or it is at a distance which is limited by said inner cylindrical surface, e.g. at a distance of some tenth of a millimeter. The closing surface 37A can be made of a material with a low friction coefficient.

The angular position of the shutters 37 can be adjustable, e.g. acting on the respective inner body 25 which can be angularly adjusted. In other embodiments it can be supposed a possibility of angular adjustment of the inner body 25 with respect to the bearing structure 13 of the interfolding machine, and further possibility of adjustment of the shutters 37 with respect to the inner body 25.

The two folding rollers 3 are substantially symmetrical, but the comb structures carried out by the shutters 37 are staggered with respect to one another as is comprehensible from the section of FIG. 1. Substantially the shutters 37 of the right (in the drawing) folding roller 3 face the empty spaces between the shutters of the left folding roller 3 and vice versa.

Each folding roller 3 has a plurality of radial suction holes, arranged in the described way below. The suction holes are indicated with 41 and 43 and are carried out in correspondence with the annular projections between annular grooves 3S, as it can be better seen in FIGS. 2 and 3.

The suction holes 41, 43 are arranged along longitudinal alignments altogether indicated with 42 and 44 (FIG. 3) aligned one another. Between two longitudinal alignments 42 is placed a longitudinal alignment 44 and, vice versa, between two longitudinal alignments 44 is placed a longitudinal alignment 42. As it will be clear from the description below, the two longitudinal alignments 42, 44 differ from one another in the position between suction holes relative to the shutters 37.

In the illustrated embodiment, each longitudinal alignment 42, 44 comprises two adjacent rows of suction holes 41, 43.

With reference to a single folding roller 3, each longitudinal alignment 42 comprises suction holes 41, while each longitudinal alignment 44 comprises suction holes 43. The suction holes 41 of a longitudinal alignment 42 are axially staggered with respect to the corresponding suction holes 43 of the adjacent longitudinal alignment 44 (see in particular FIGS. 2 and 3).

The distance in axial direction, indicated with D in FIG. 3, of suction holes 41 which are axially consecutive is identical to the axial distance, also indicated with D, of suction holes 43 of the adjacent alignment. The distance D corresponds to the step between the shutters 37.

This way, as clearly illustrated in FIG. 2, all the suction holes 41 of an alignment 42 are located in correspondence with respective shutters 37, while all the suction holes 43 of the adjacent longitudinal alignment 44 are located in correspondence of the empty space between adjacent shutters 37.

This arrangement is identical for both the folding rollers 3.

As observed above, the folding rollers 3 are symmetrical except that the shutters 37 of one of them (3) are staggered with a different step with respect to the shutters 37 of the other one. Analogously the suction holes 41 and 43 will be staggered with respect to one another in the longitudinal direction, i.e. substantially parallel to the rotation axis 3A.

This is easy to understand from the sectional view of FIG. 1, where for the left folding roller 3 the suction holes 43 are on the sectional plane (and thus shown with solid lines) and the suction holes 41 are behind the sectional plane (shown with dashed lines), while for the right folding roller 3 the situation is the opposite: the suction holes 41 are visible since they are located on the sectional plane (which dissects also the respective shutter 37) while the suction holes 43 are shown with dashed lines, since they are located behind the sectional plane (and thus between two consecutive shutters 37).

Always with reference to FIG. 1 it must be observed that for the right folding roller 3 on the sectional plane there is a shutter 37 which corresponds to the position in the longitudinal direction, i.e. parallel to the rotation axis 3A, of the suction holes 41 while for the left roller the sectional plane is located staggered with respect to the position of the shutter 37.

The alignments 42, 44 of the holes 41, 43 are staggered with respect to one another with an angle equal to nearly 60° around the rotation axis 3A of the respective folding roller 3, since on each folding roller 3 are provided six of such alignments, placed according to a constant angular step, for a total of twelve rows of holes.

In other embodiments can be provided a number different from six (always even numbers) of longitudinal alignments 42, 44 of holes alternated with respect to one another as described above.

Between adjacent rows of each alignment 42 of suction holes 41 notch-shaped folding members or notches 47 can be found, defined in the annular projection defined by adjacent annular grooves 3S. Analogous notches 49 can be found between the two rows of suction holes 43 of each longitudinal alignment 44.

These or those notches 47, 49 can be replaced by protrusions, so that in the folding nip 5 a sequence of notches and a sequence of protrusions will correspond to each other from time to time in the sense described below.

The two folding rollers 3 rotate at the same peripheral speed and in opposite directions according to the arrows f3 (FIG. 1). They are phased one another in such a way that in the folding nip 5 holes 43 of a roller and holes 41 of the other roller will be found from time to time corresponding to one another.

Moreover, each folding roller 3 and the respective cutting roller 7 are angularly synchronized to one another so that during rotation of the rollers 3, 7, which rotate at a substantially identical peripheral speed, in the transfer nip 15 of the alignments 42 of suction holes 41 are located in correspondence with the cutting blades 9. Vice versa, the suction holes 43 of the alignments 44 are located in an intermediate position between cutting blades 9 consecutively with respect to the cutting roller 7.

The operation of the interfolding machine till now summarily described can be better understood by examining the operative sequence of FIGS. 4-9.

In FIGS. 4-9 the two folding rollers are indicated with the references 3L (the left folding roller) and 3R (the right folding roller), for a better understanding of the description. In the sequence of FIGS. 4(C), 5(C) . . . 9(C) are indicated with letters (a), (b), (c), (d), (e) and (f) the six longitudinal alignments of suction holes of the folding roller 3L.

With the references F1, F2, F3 . . . Fn are indicated sheets of web material with cutting carried out by means of the cutting rollers 7 and by the respective counter-blades 11, the two ribbons of web material N1, N2. The sheets F1, F3, F5 (the odd sheets, coming from the web material N1) are fed in a sequential way to the folding roller 3R and the sheets F2, F4, F6 (the even sheets, coming from the web material N2) are fed to the folding roller 3L.

The six groups of figures FIG. 4-FIG. 9 show the angular position assumed in a sequential way by the folding rollers 3 and by the cutting rollers 7 during the operation cycle, i.e. a complete rotation of 360°, with a step of 60°. FIGS. 4(A), 5(A) . . . 9(A) show the section according to the first section plane A-A of FIG. 3, while FIGS. 4(B), 5(B) . . . 9(B) show the section according to the outline plane B-B in FIG. 3.

Figure 4A:
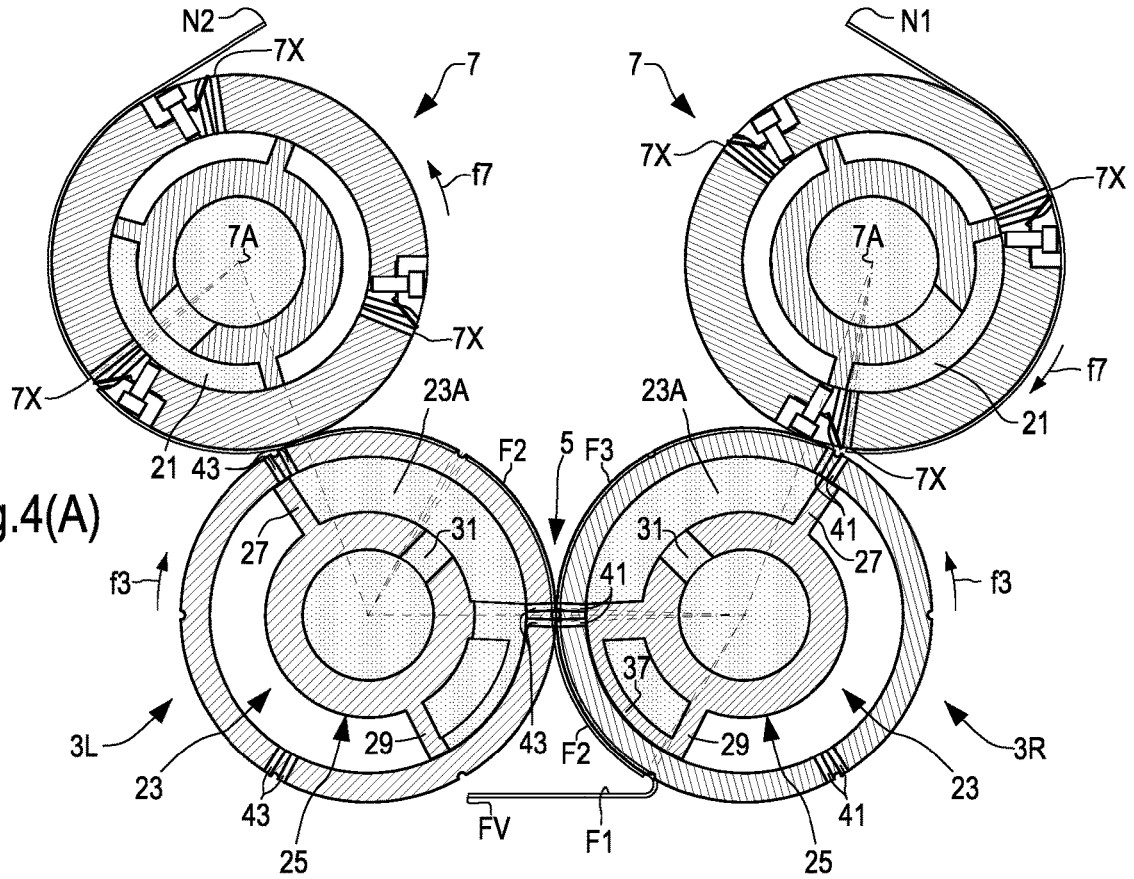
FIGS. 4(A), 4(B) & 4(C) illustrate a first step in an illustrative operative sequence of the interfolding machine.

In more details, in FIG. 4(A) is shown the section of the folding rollers 3L, 3R on the outline sectional plane A-A in FIG. 3. The outline plane A-A intersects the shutters 37 of the folding roller 3R, while it passes between two adjacent shutters 37 of the folding roller 3L, so an adjacent shutter of the folding roller 3L is forwardly visible.

Therefore, in FIG. 4(A) the suction holes 43 of the folding roller 3L are on the sectional plane, while the suction holes 41 are behind the sectional plane. Vice versa, for the folding roller 3R the suction holes 43 are behind the sectional plane and the suction holes 41 are on the sectional plane.

Figure 4B:
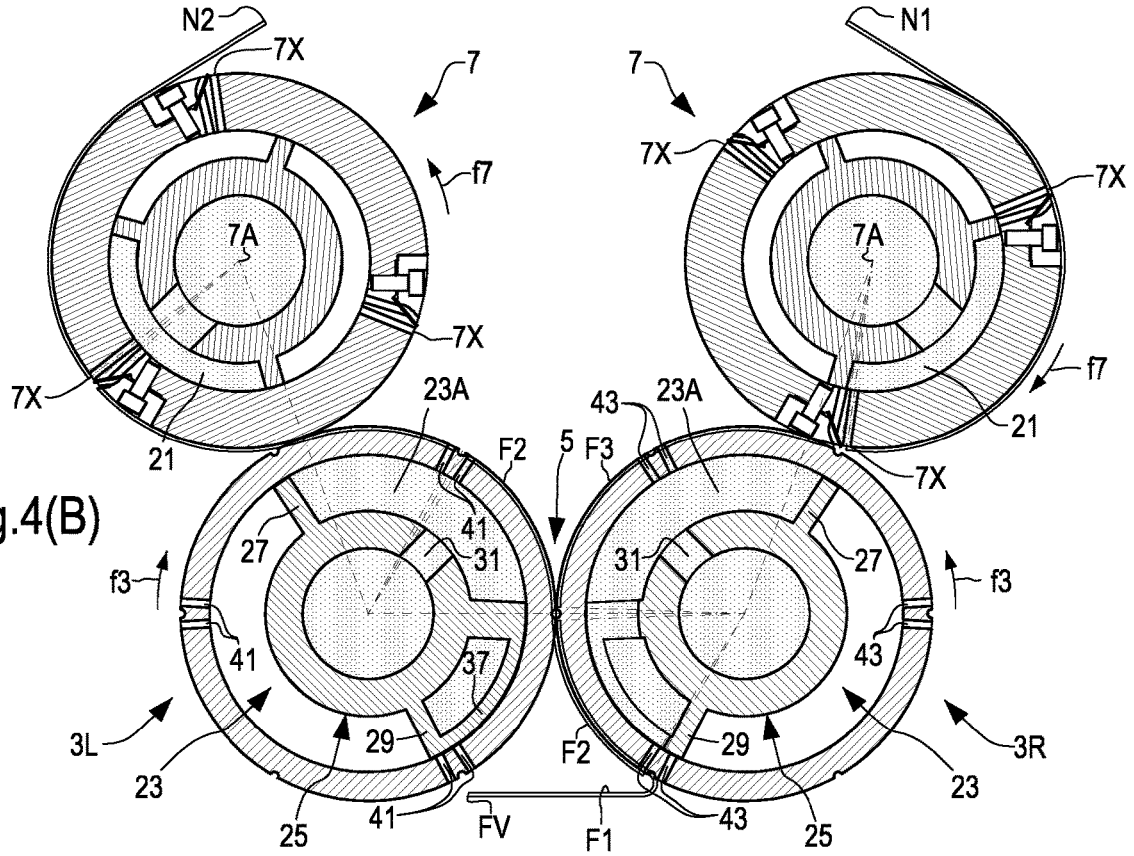

FIG. 4(B) shows the same folding rollers 3L and 3R in the same angular position of FIG. 4(A), but sectioned according to the plane B-B in FIG. 3, which is staggered with respect to the plane A-A of a step corresponding to a half of the distance between the two shutters 37.

So FIG. 4(B) shows, for the folding roller 3L, the suction holes 41 in the sectional plane and the suction holes 43 behind the sectional plane. For the folding roller 3R, instead, the suction holes 41 are behind the sectional plane and the suction holes 43 are shown exposed in the sectional plane. The shutters 37 of the folding roller 3L are on the sectional plane, while in the folding roller 3R the sectional plane passes through two adjacent shutters 37, so in FIG. 4(B) an adjacent shutter of the shutters of the folding roller 3R is forwardly visible.

Figure 4C:
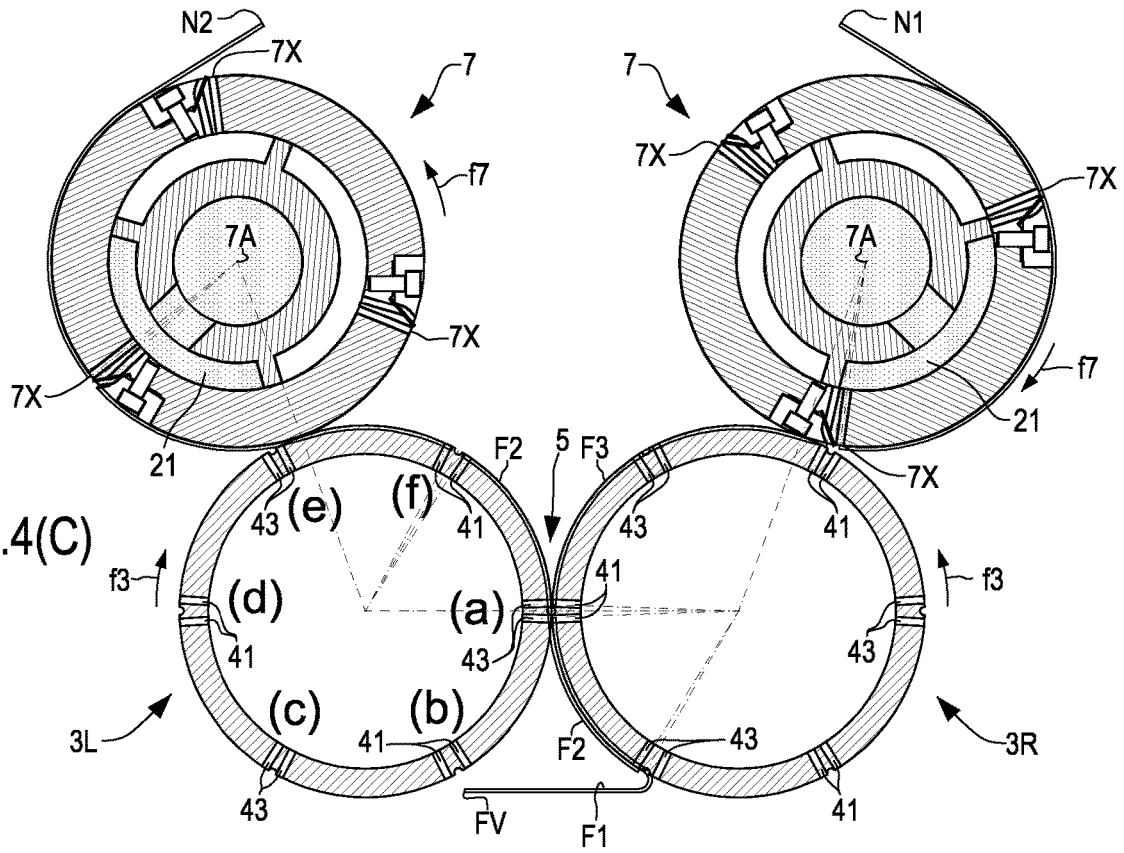

FIG. 4(C) shows in a schematic way and for a better representation all the six alignments of suction holes in both the folding rollers 3R and 3L. For this latter the six alignments are countermarked with letters from (a) to (f). In FIG. 4(C) the inner members of the folding rollers 3R and 3L (radial walls 27, 29, shutters 37) are omitted.

In FIGS. 4(A) and 4(B) the inner zone of the respective cylindrical sleeves 3C of the folding rollers 3L, 3R in which there is suction is shaded.

FIGS. 4(A)-4(C) show the following condition. The suction holes 43 of the longitudinal alignment indicated with letter (a) (FIG. 4(C)) of the folding roller 3L are positioned in the folding nip 5, in front of or facing the corresponding suction holes 41 of the folding roller 3R. A first sheet F1 is in detachment phase from the folding roller 3R.

The sheet F1 has been carried out by the cutting of the web material N1 fed to the folding roller 3R. In FIG. 4 the sheet F1 is folded in the middle and kept off the surface of the folding roller 3R along the central folding line by means of the alignment of the suction holes 43 directly downstream the folding nip 5 with respect to the rotation direction.

The border downstream (Fv) of the sheet F1 has been previously detached from the folding rollers, while the border upstream of the sheet F1 is sticking to the folding roller 3R and it is kept therein by suction through the suction holes 41 of the folding roller 3R which are located in the folding nip 5, see FIG. 4(A).

In the folding nip 5, in front of the upstream border of the sheet F1, there is the middle of a second sheet F2, which has been carried out by cutting the web material N2 fed to the folding roller 3L. The downstream border of the sheet F2 is sticking to the folding roller 3R, and it is kept by the suction holes 43 which keep also the folding line of the middle of the sheet F1.

Basically, the second sheet F2 is placed half sticking to the folding roller 3R, and half sticking to the folding roller 3L. The middle line of the sheet F2 is kept by suction on the folding roller 3L by means of the suction holes 43 of the longitudinal alignment countermarked by the letter (a) in the folding nip 5. The upstream border of the sheet F2 is placed in correspondence with the suction holes 41 of the alignment (f) of the folding roller 3L, see FIG. 4(C).

A sheet F3, carried out by cutting web material N1, is sticking to the surface of the folding roller 3R, by means of the three alignments of the suction holes 41, 43, 41, of the folding roller 3R.

More in particular, the downstream border of the sheet F3 is kept by the suction holes 41 of the folding roller 3R which are placed in the folding nip 5, while the upstream border is sucked by the suction holes 41 of the folding roller 3R which are placed in the transfer nip 15 between the folding roller 3R and the corresponding cutting roller 7. The middle of the sheet F3 is sucked by the alignment of suction holes 43 which is placed on the folding roller 3R immediately upstream (with respect to the rotation direction) of the folding nip 5.

In FIGS. 4(A), 4(B) with reference to the folding roller 3L it is observed that the suction holes 43 of the alignment (a), placed in the folding nip 5, remain in communication with the suction chamber 23A for the following rotation of nearly 60° (adjustable acting on the angular position of the wall 29), because they 43 are placed between adjacent shutters 37 and thus they are not closed by the shutters 37.

Vice versa, the suction holes 41 of the folding roller 3R which are placed in the nip 5 stop sucking from this position forward, since they are closed by the shutters 37 of the folding roller 3R and thus they are no more in communication with the suction chamber 23A inside the folding roller 3R. Also the holes 43 of the roller 3R downstream the folding nip 5 (alignment (b) of suction holes) that reach the radial wall 29, stop sucking (interrupted).

Figure 5A:
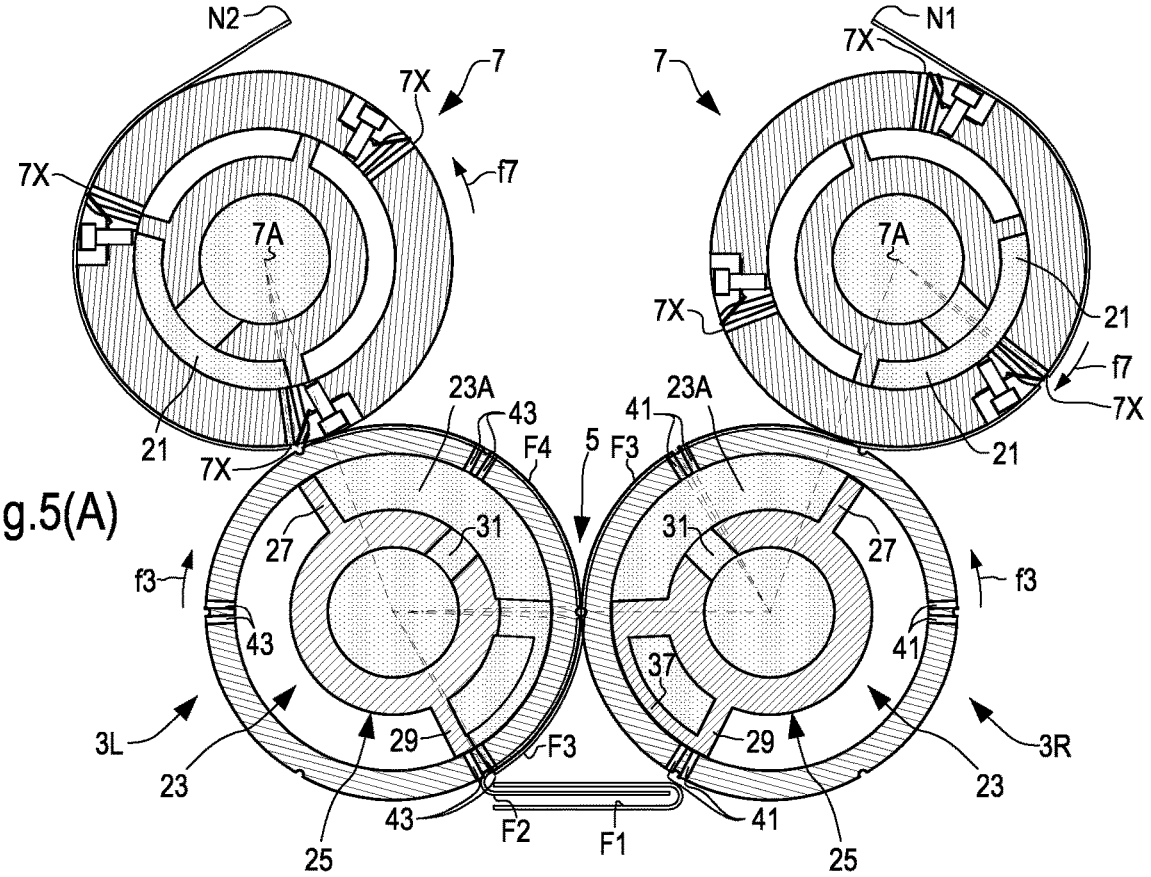
FIGS. 5(A), 5(B) & 5(C) illustrate a second step in the operative sequence of the interfolding machine.
Figure 5B:
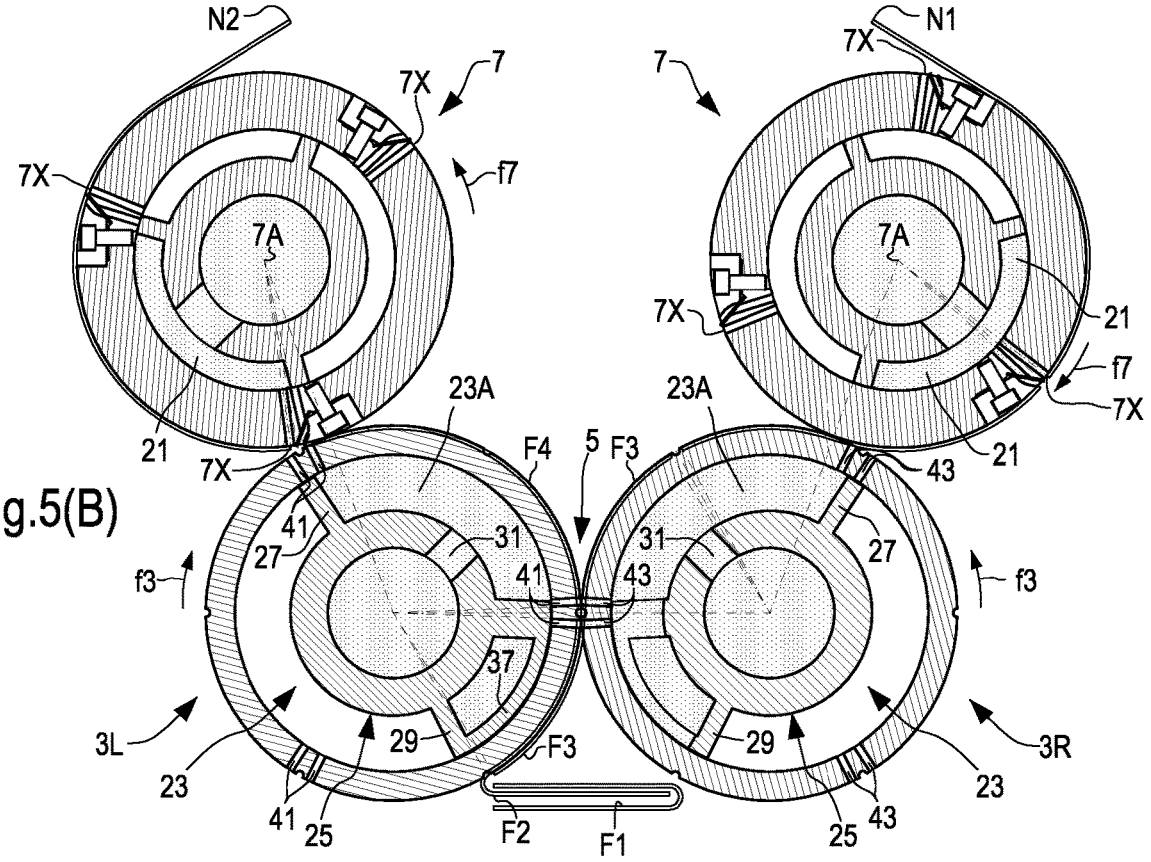
Figure 5C:
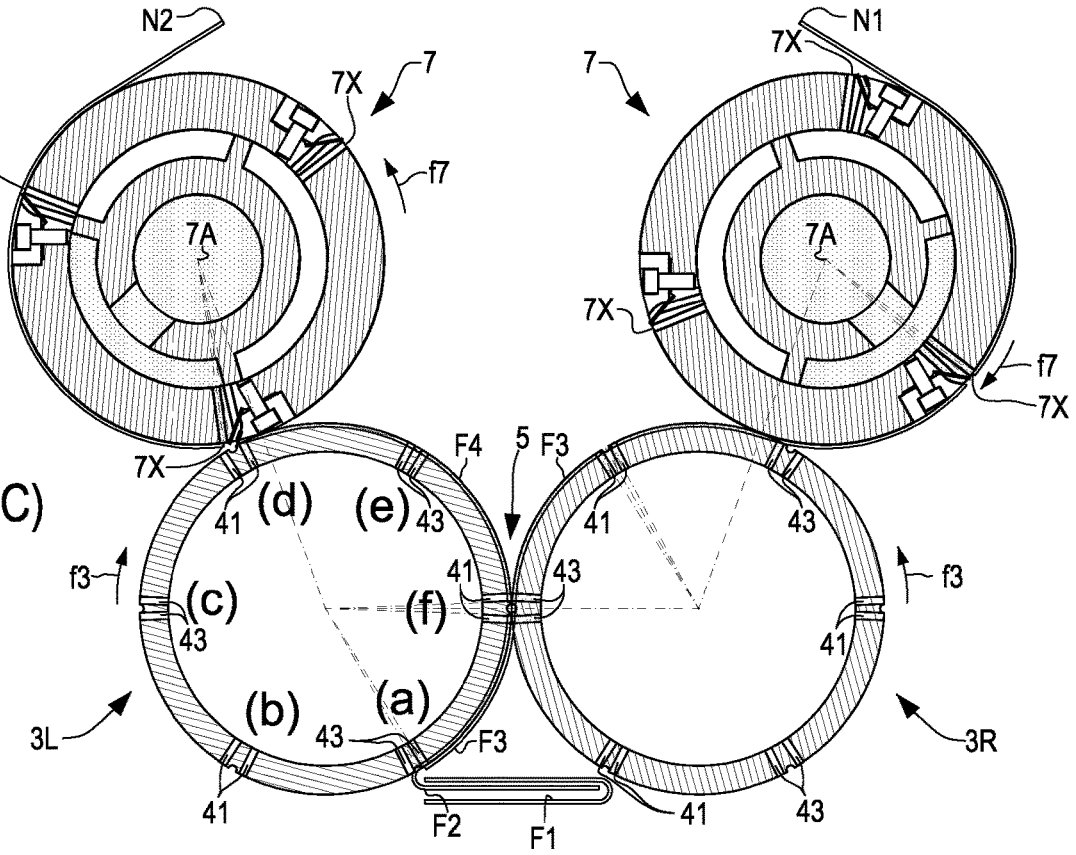

FIGS. 5(A), 5(B) and 5(C) show the same views of FIGS. 4(A), 4(B) and 4(C) after a rotation of 60° of the folding rollers 3L, 3R and of the respective cutting roller 7. The sheet F1 has been detached, by means of respective removing comb 17, from the folding roller 3R.

The most advanced half of the second sheet F2 is interfolded with the sheet F1 and the most advanced border of the second sheet F2 has been detached from the folding roller 3R. The detachment of the sheets of web material from the folding roller 3R is carried out by the combined effect of the removing combs 17 and of the stop of suction through the suction holes 43 of the roller 3R which have been closed by the shutters 37 of the folding roller 3R.

Always with reference to FIGS. 5(A)-5(C) the second sheet F2 is engaged in correspondence with the middle fold from the suction holes 43 (position (a), FIG. 5(C)) of the folding roller 3L which are going to reach the radial wall 29 of the folding roller 3L, where the suction will be interrupted.

The rear border of sheet F2 is engaged to the suction holes 41 (alignment (f) of the folding roller 3L) which reached the folding nip 5. Here, because of the effects of the shutters 37 of the roller 3L, the suction on the upstream border of sheet F2 by the roller 3L stops and such border will be attracted by the alignment of suction holes 43 of the folding roller 3R which are located in the folding nip 5 and which will remain in communication with the suction chamber 23A of the folding roller 3R for the next rotation of 60°. This because these suction holes 43 of the folding roller 3R are staggered with respect to the shutters 37 and are not closed by these latter.

The most advanced border of sheet F3 has been detached from the folding roller 3R, because the suction holes 41 of the folding roller 3R (of FIG. 4 and not of FIG. 5) which were keeping it stopped sucking (FIG. 4) starting from the nip 5 being closed by the shutters 37 inside the folding roller 3R. The most advanced border of sheet F3, so, has been engaged by the suction of the suction holes 43 of the alignment (a) of the folding roller 3L and it is sticking to the roller 3L in the point of middle fold of sheet F2.

Figure 6A:
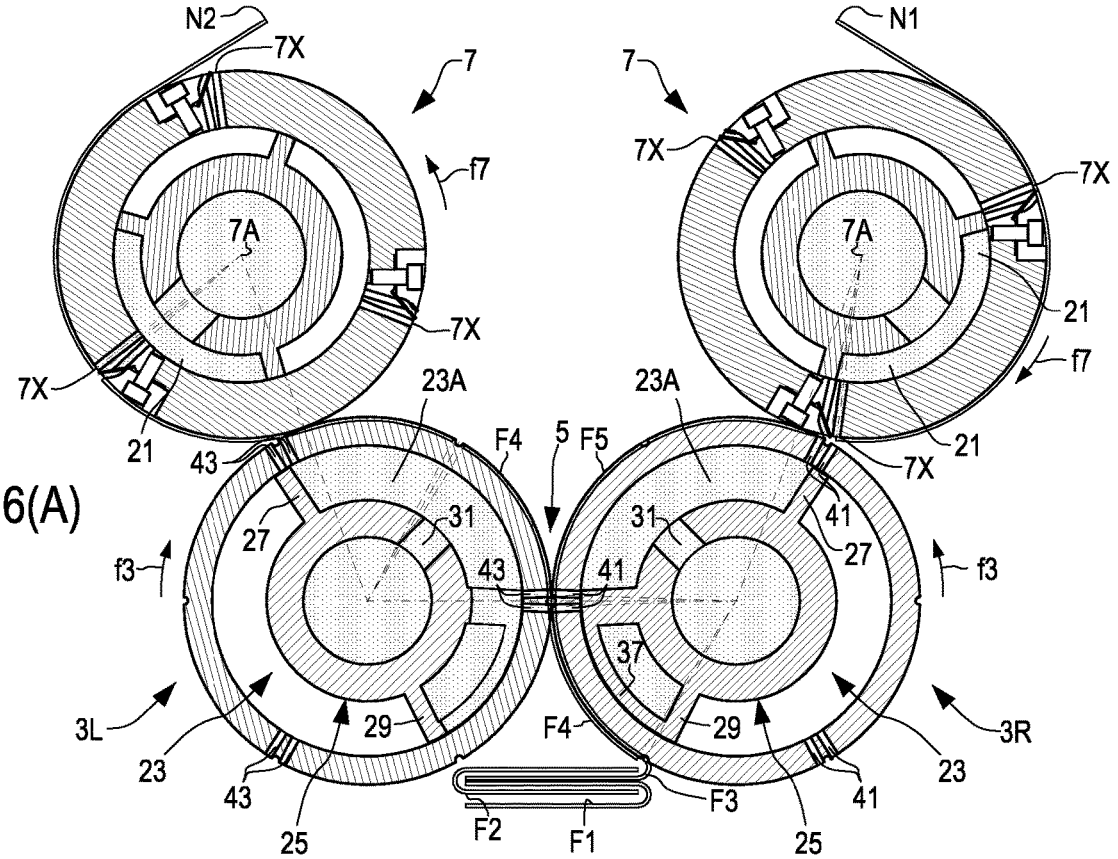
FIGS. 6(A), 6(B) & 6(C) illustrate a third step in the operative sequence of the interfolding machine.
Figure 6B:
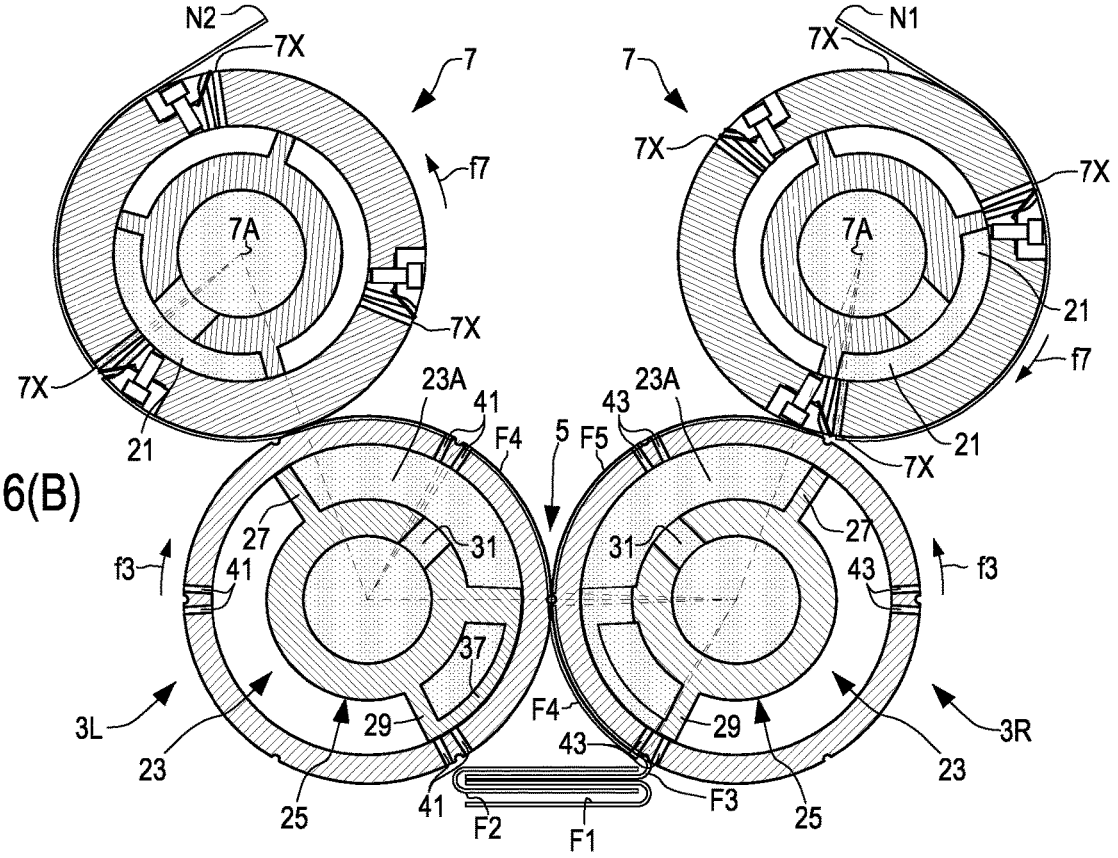
Figure 6C:
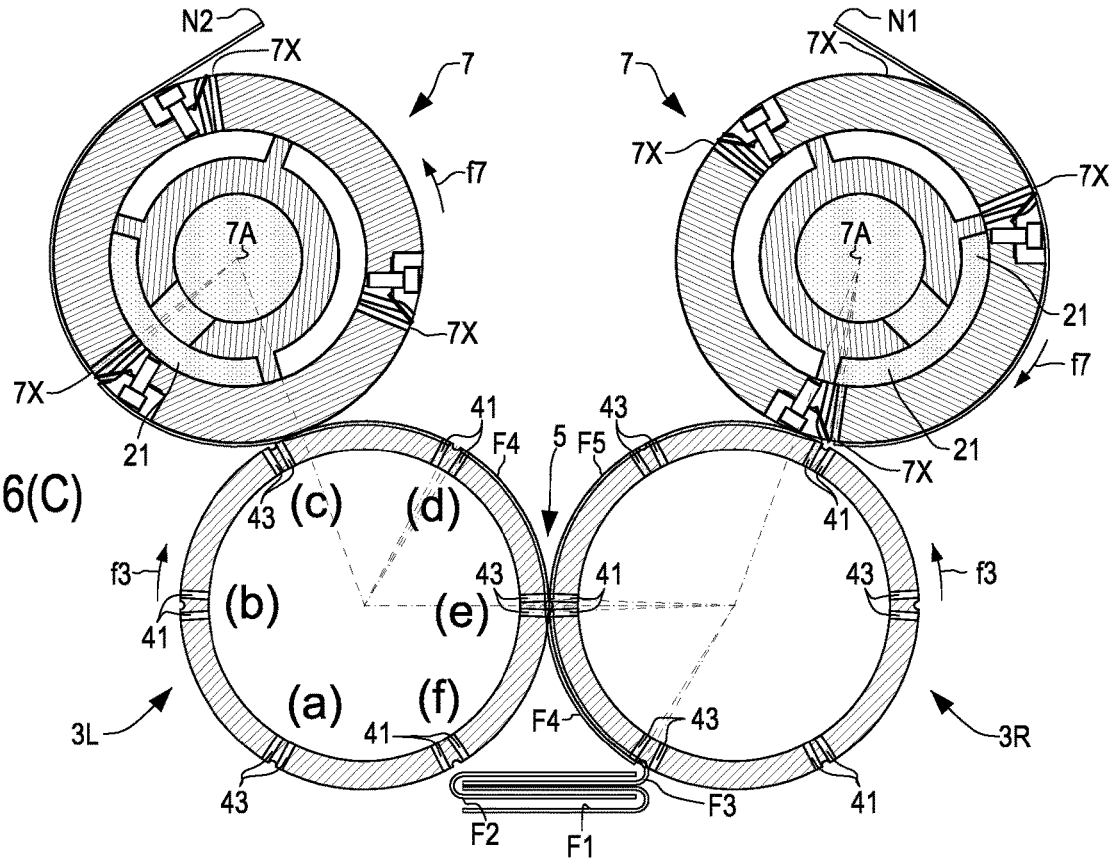

FIGS. 6(A)-6(C) show the following phase, after a new rotation of 60° of the folding rollers 3L, 3R and of the respective cutting rollers 7. The sheet F2 has been completely detached by the folding roller 3R by means of the combined effect of the stop of suction through the suction holes 43, which stop sucking reached the radial wall 29, and of the removing comb 17. Between the two folded halves of sheet F2 there is the half of sheet F1 and half of sheet F3.

The other half of sheet F3 is still sticking to the folding roller 3R. The central fold line of sheet F3 is kept by the suction holes 43 of the folding roller 3R, which 43 keep also the downstream border of the following sheet F4. The suction will stop once the radial wall 29 of the folding roller 3R is passed. The upstream border, i.e. the rear one, of sheet F3 is sticking to the folding roller 3R because attracted by the suction holes 41 which in FIG. 6 are in the folding nip 5.

The suction stops in this point because of the closure of such suction holes 41 by the shutters 37 of the folding roller 3R. The upstream border of sheet F3 will thus be attracted on the surface of the folding roller 3L because of the effect of the suction through the suction holes 43 of the alignment (e) which are in the nip 5, suction which will be maintained for the following rotation of 60°, up to the reaching of the radial wall 29 of the folding roller 3L.

The suction holes 43 of the alignment (e), which in the angular position of FIGS. 6(A)-6(C) are in the folding nip 5, keep sticking to the folding roller 3L also the central line of the following sheet F4 which has been carried out by cutting web material N2. The upstream border of sheet F4 is kept on the surface of the folding roller 3L by effect of suction through the suction holes 41 of the alignment (d), see FIG. 6(B).

Figure 7A:
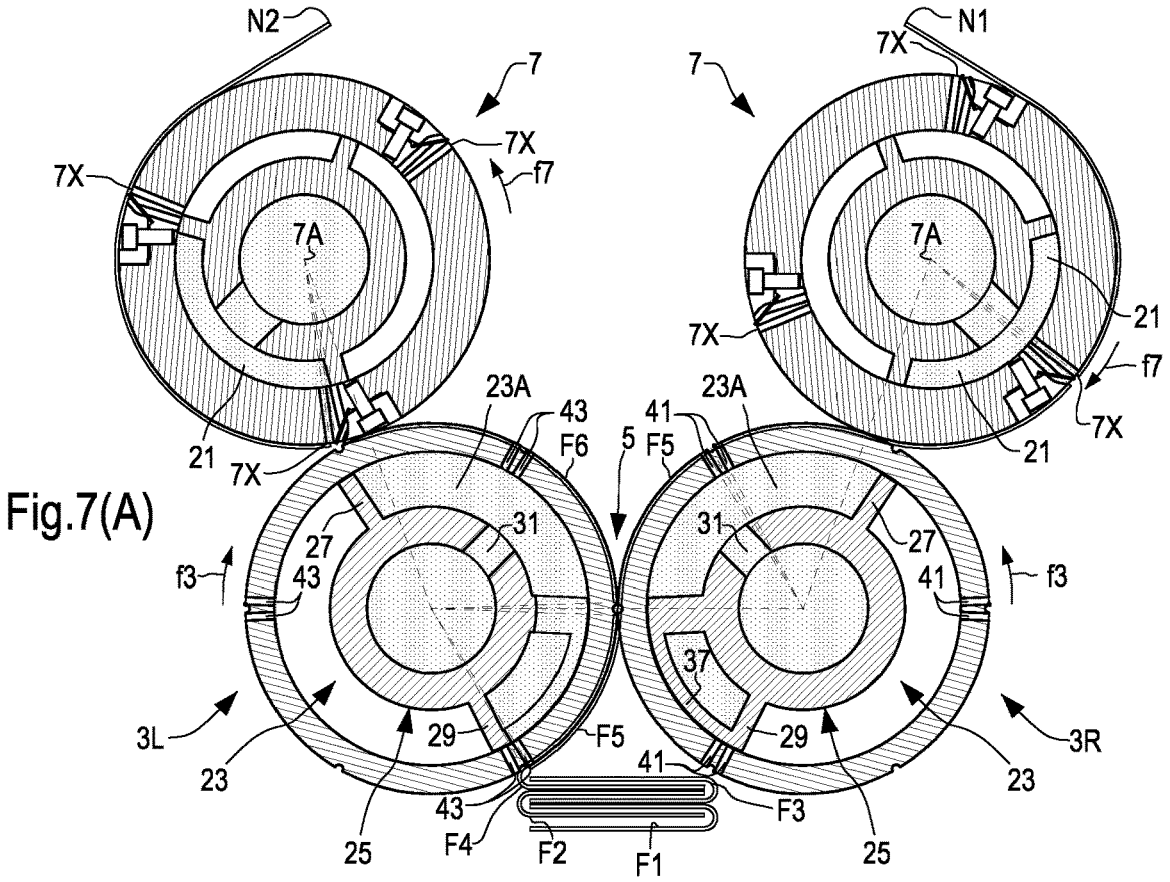
FIGS. 7(A), 7(B) & 7(C) illustrate a fourth step in the operative sequence of the interfolding machine.
Figure 7B:
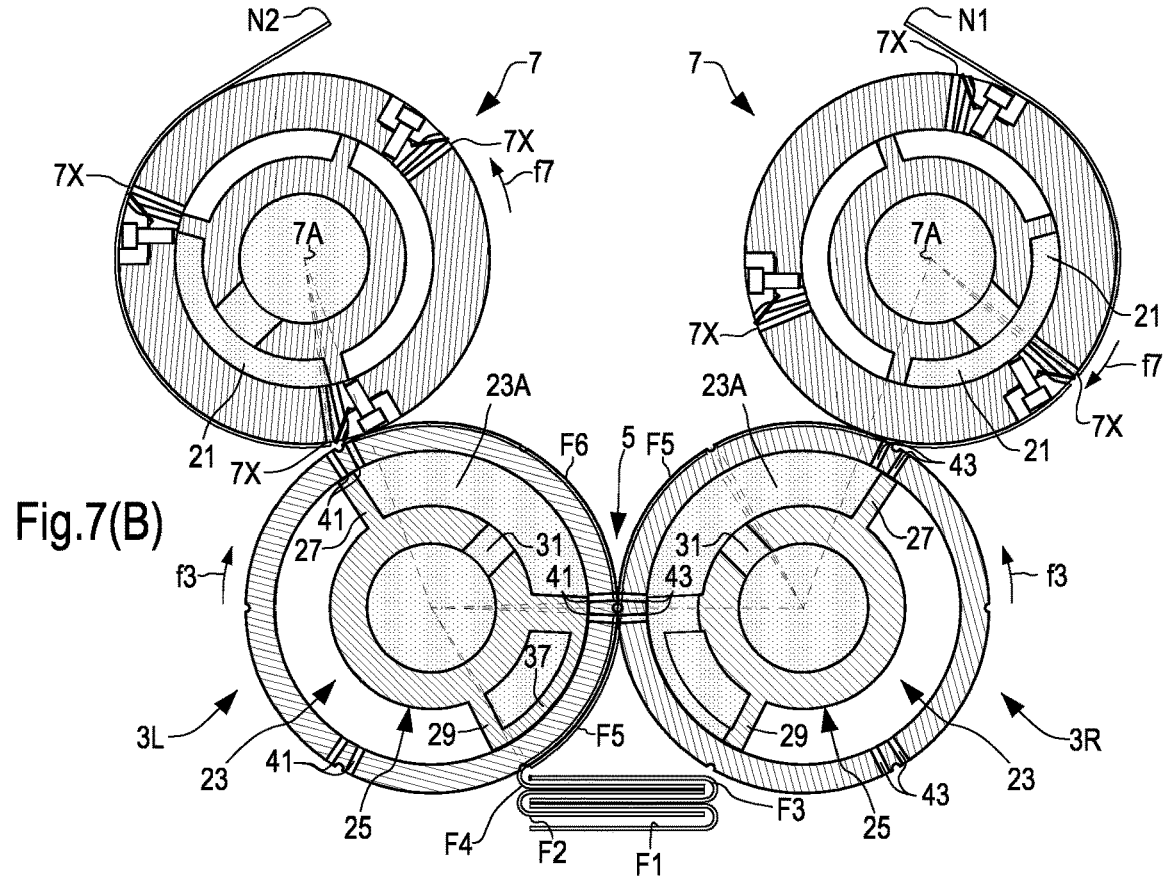
Figure 7C:
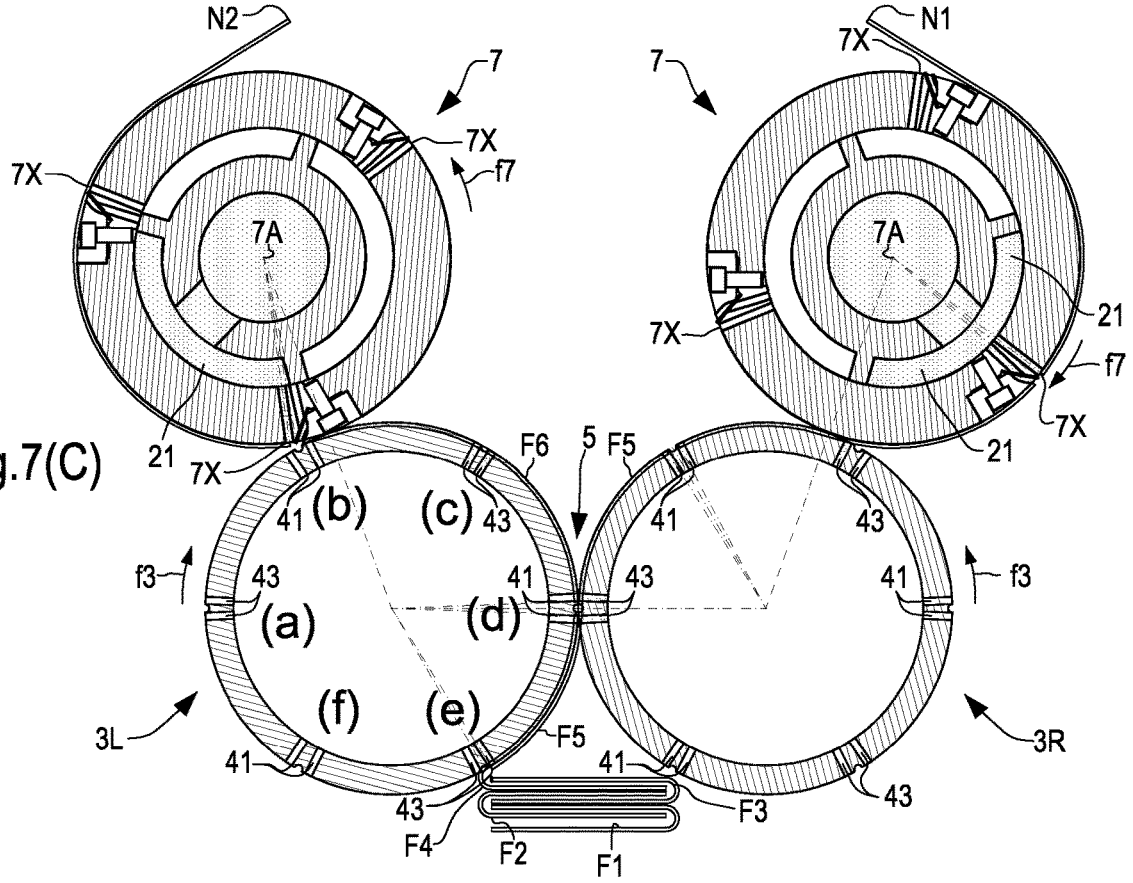
Figure 8A:
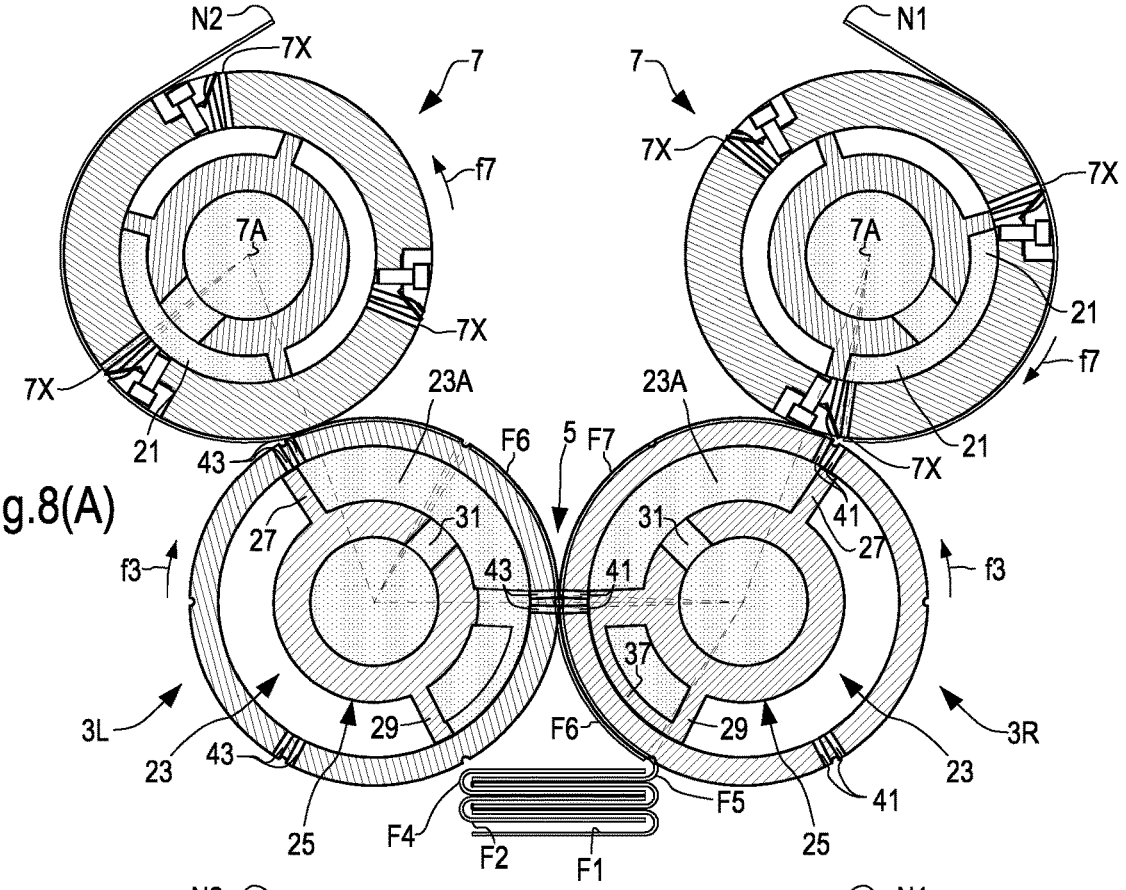
FIGS. 8(A), 8(B) & 8(C) illustrate a fifth step in the operative sequence of the interfolding machine.
Figure 8B:
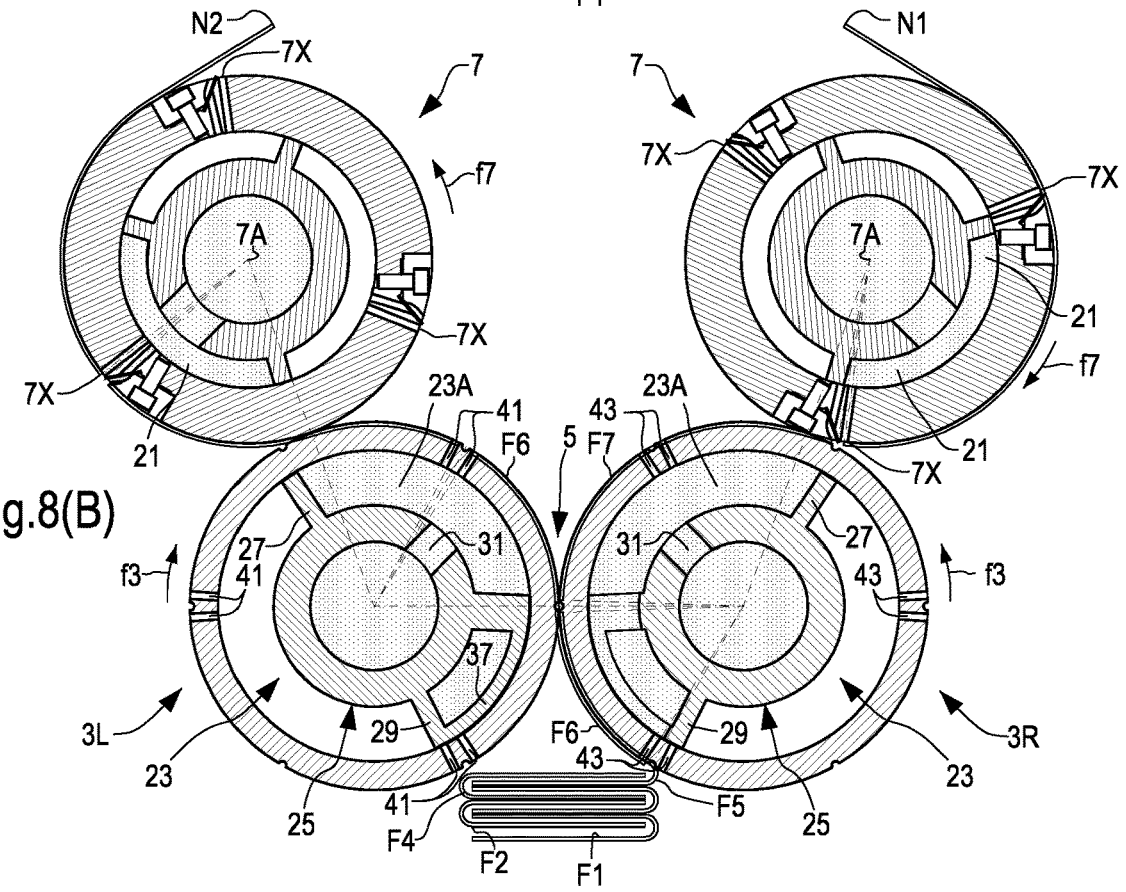
Figure 8C:
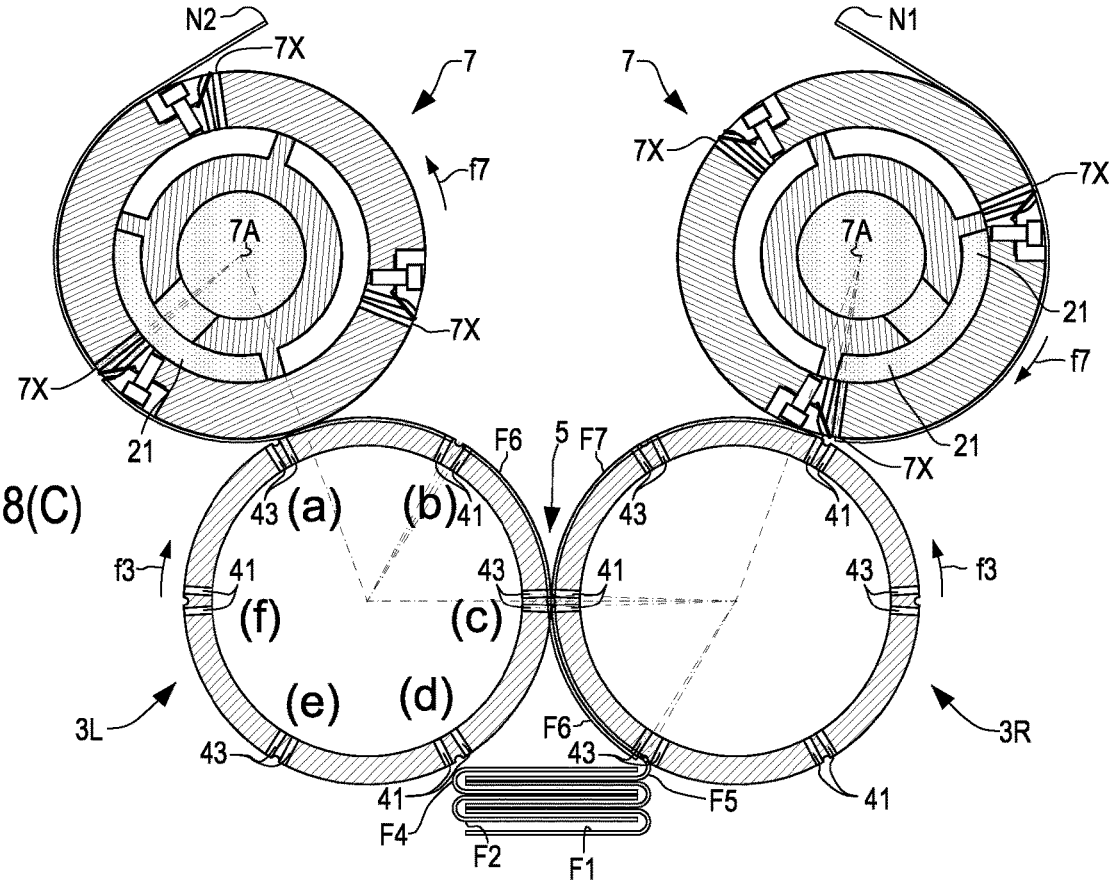
Figure 9A:
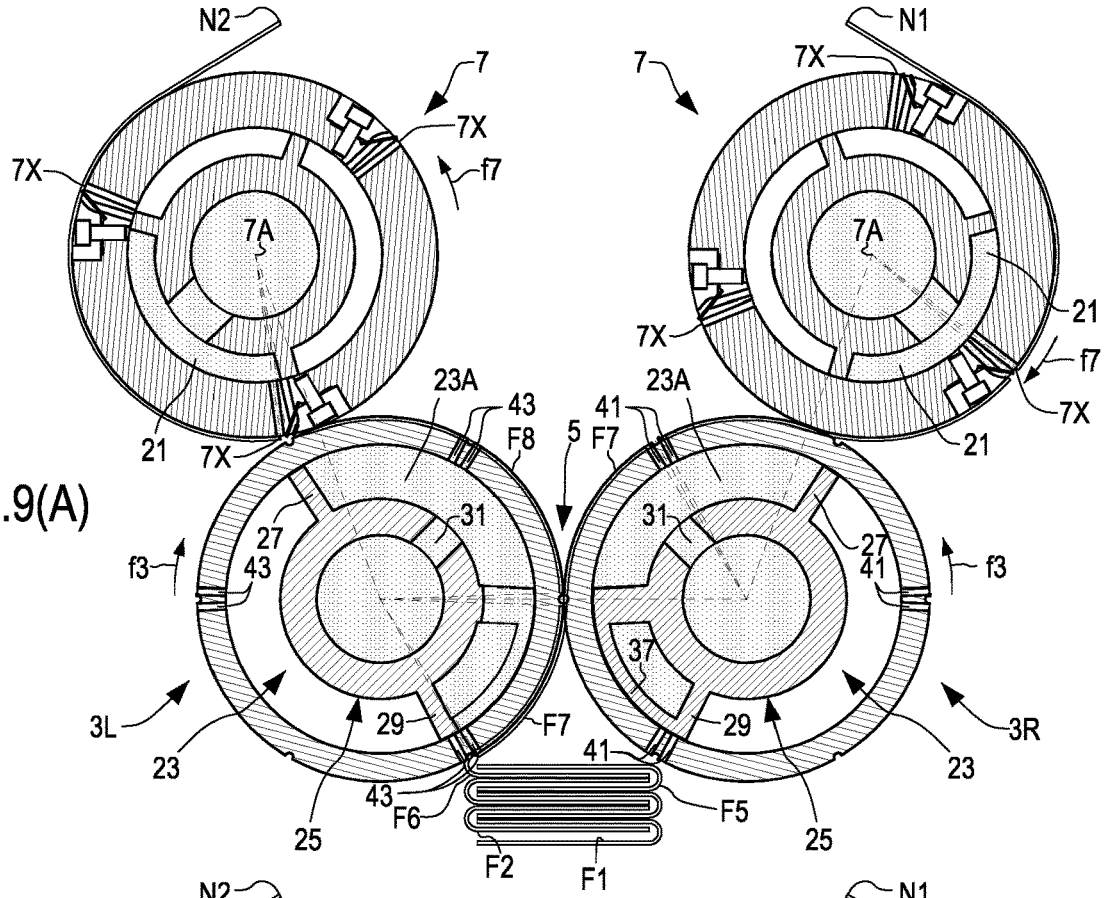
FIGS. 9(A), 9(B) & 9(C) illustrate a sixth step in the operative sequence of the interfolding machine.
Figure 9B:
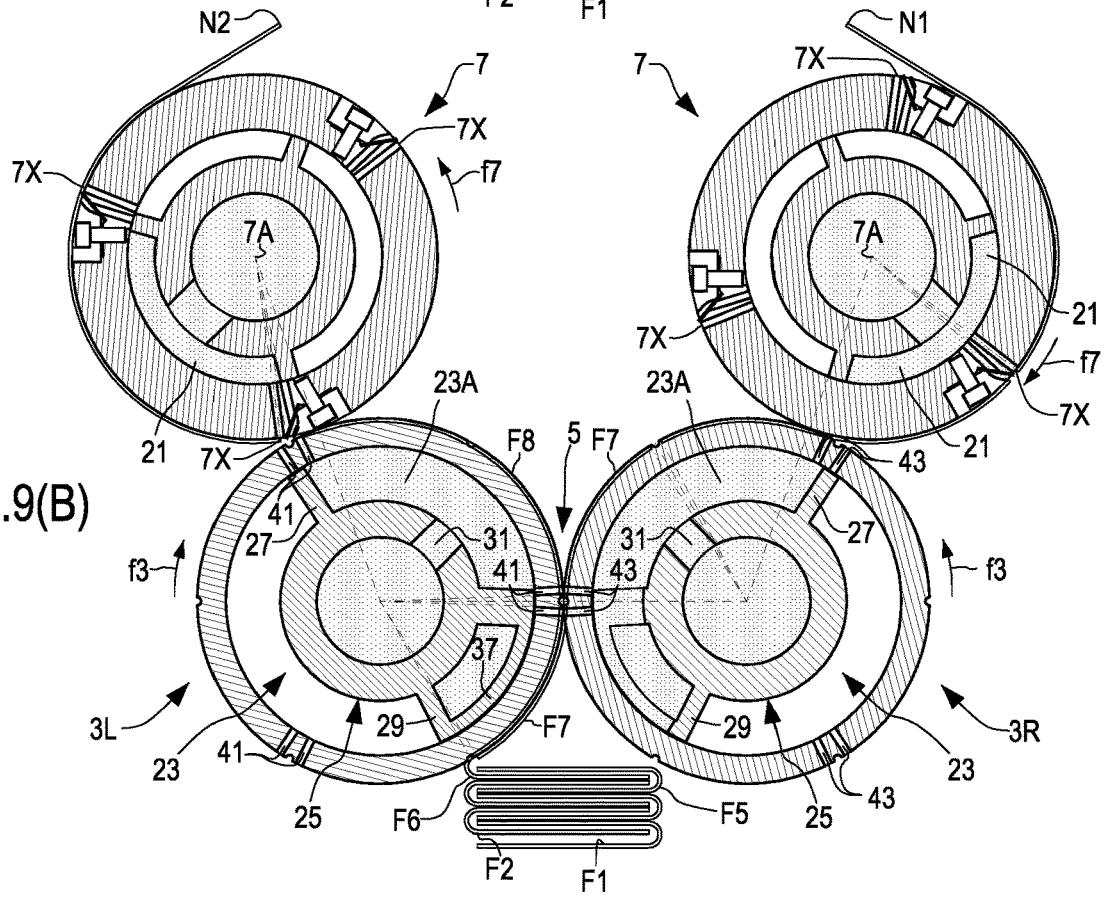
Figure 9C:
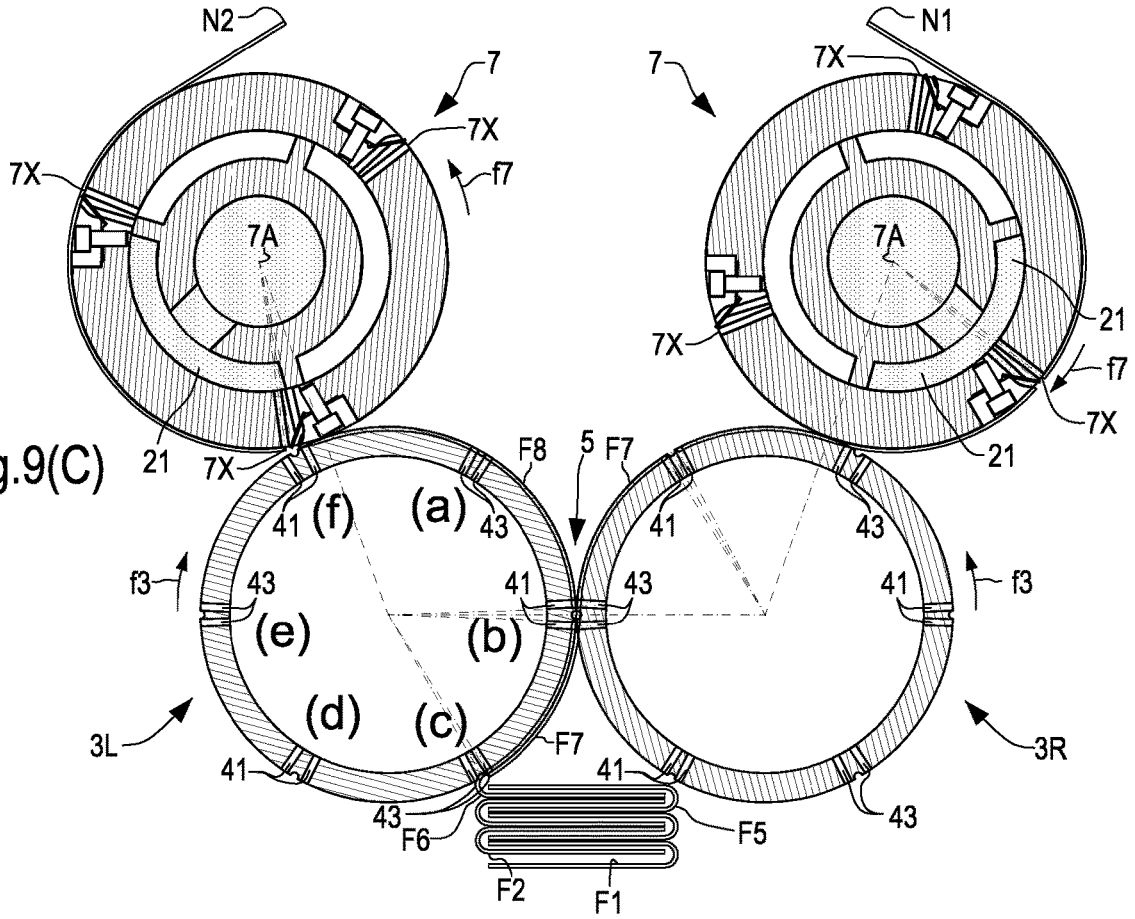

The following FIGS. 7-9 show, with a rotation of 60° from a figure to another, the movement of the folding roller 3L, 3R and of the respective alignments of suction holes 41, 43, as well as the effect of interruption of suction operated by the stationary shutters 37 which are inside the folding roller 3L and 3R with repetition of phases described above, for the following sheets F3-F7.

After all, as it is understood from the sequence of FIGS. 4-9 the sheets F1, F2, F3 . . . Fn carried out by cutting the web material N1, N2 and alternatively fed to the folding roller 3R, 3L are bended and interfolded by means of the effect of alternated suction through suction holes 41, 43 of the two folding rollers.

The presence of the shutters 37 with comb structure and the longitudinal stagger of the alignments of the suction holes 41, 43 allows to activate and deactivate the suction in angular correct positions to carry out the bending of the sheets and the interfolding of the bended sheets. Movable members for opening and closing the suction and relative control softwares and hardwares are not necessary.

Moreover, as the shutters 37 act directly on the suction holes 41, the minimum volume between the suction point (mouth of the suction hole 41 of the outer surface 3X of the sleeve 3C of the folding roller 3) and the interception point or closure of the suction (inner surface 3Y of the sleeve 3C of the folding roller 3) is minimized.

The opening and closure of the suction are carried out in a timely and precise way, without typical inertias of systems in which suction opening and closure members are spaced with respect to the suction holes on the external cylindrical surface of the folding rollers.

Numerous variants are possible for the exemplificative and non-limitative structure above described and represented in the enclosed drawings. For example, while in the described machine are provided two cutting rollers 7 and two folding rollers 3 cooperating with the cutting rollers, as well as fixed counter-blades 11 cooperating with blades 9 carried by the cutting rollers, so as to transfer cut sheets from each cutting roller 7 to the respective folding roller 3, in other embodiments blades 9 may be placed on the folding rollers 3 and let such folding rollers 3 and the respective cutting blades cooperate directly with the counter-blades 11. The cutting rollers 7 would be in that case omitted.

In the described embodiment with reference to FIGS. 1-9 the suction holes 41 and the suction holes 43 are staggered with respect to each other in a longitudinal direction, i.e. substantially parallel to the rotation axis 3A of the respective folding roller 3, or more exactly of the cylindrical liner or sleeve 3C of the roller.

This way the suction holes 43 are interposed between adjacent surfaces 37A of the comb shutters 37, while the suction holes 41 are in phase with the surfaces 37A of the comb shutters and are closed by these latter. This configuration is actually preferred, because it simplifies the mechanical manufacturing of the cylindrical sleeve 3C of the folding roller 3.

Nevertheless, there are other ways to obtain opening and closure of the suction through the suction holes 41, 43 according to the angular position of the folding roller 3.

Figure 10:
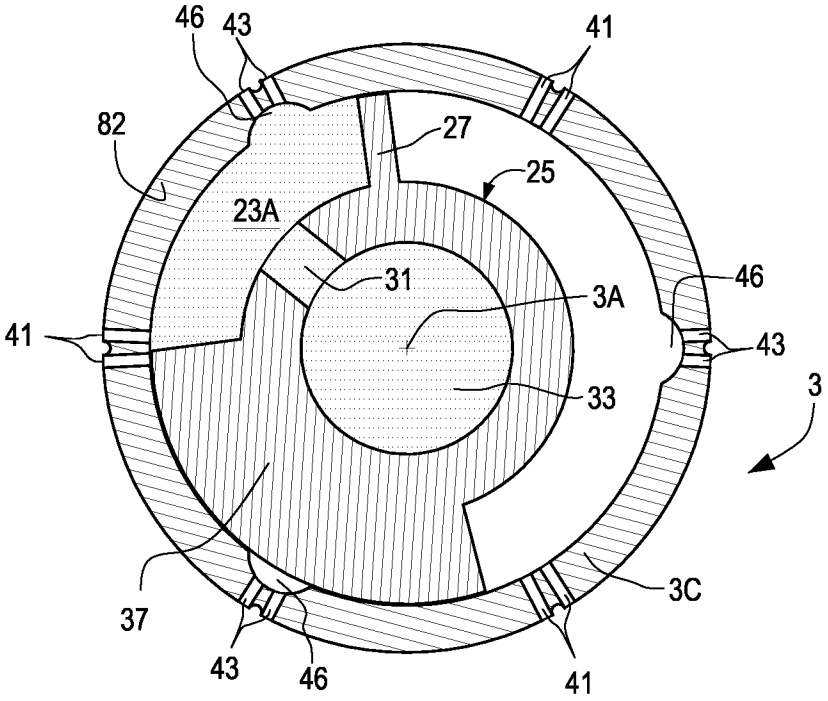
FIGS. 10 and 11 show a modified embodiment of the folding roller.
Figure 11:
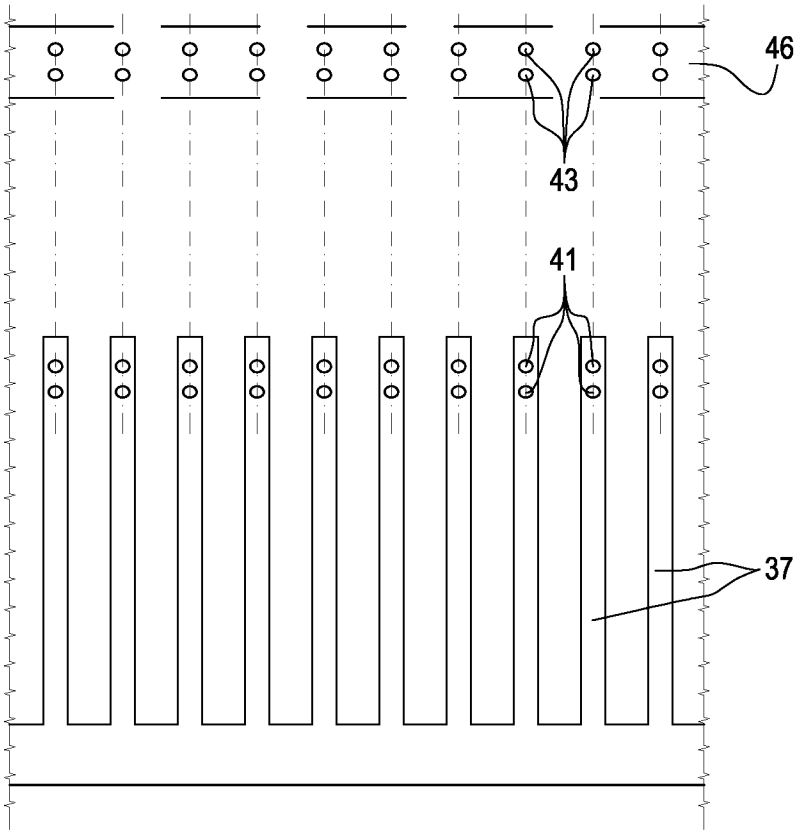

An alternative embodiment is illustrated in FIGS. 10 and 11, where FIG. 10 is a cross section of one of the sucking folding rollers 3, while FIG. 11 is a partial side view of the side surface of the folding roller.

In this embodiment shutters 37 with a comb structure are provided as in FIGS. 1-9, see FIG. 11, the holes 41 and the holes 43 are arranged according to longitudinal alignments, substantially parallel to the rotation axis 3A of the cylindrical sleeve 3C of the folding roller. In opposition to the embodiment of FIGS. 1-9, in FIGS. 10 and 11 the holes 41 and 43 are not staggered in an axial direction, but aligned along circumferential lines (see FIG. 11). The circumferential lines are aligned with the surfaces 37A of the comb shutters 37.

With this arrangement, the holes 41 are closed by the surfaces 37A of the comb shutters 37 in such an identical way described above with reference to FIGS. 1-9. Since also the holes 43 are aligned with the comb shutters 37 and the respective closing surfaces 37A, in order to avoid that the holes 43 are closed by the shutters 37, in the embodiment illustrated in FIGS. 10 and 11 along the longitudinal alignments 44 of the suction holes 43, of the inner surface 3Y of the cylindrical sleeve 3C are made longitudinal nips 46, which ensure the suction holes 43 are not to be closed by the closing surface 37A of the comb shutters 37.

Basically, the suction holes 43 are shorter than the suction holes 41 and end in the nip 46. This way, when the suction holes 43 are in front of the corresponding closing surface 37A, this latter cannot close the suction holes through which the suction is generated by effect of the nip 46 which connects the holes 43 with the empty spaces between adjacent shutters 37.

With this arrangement, so, the suction through the suction holes 41 and 43 is opened and closed in such an identical way described above with reference to FIGS. 1-9, even if a staggered position in a longitudinal direction (parallel to the axis 3A) of the holes 41 with respect to the holes 43 is not provided.

In all the illustrated embodiments it is obtained a substantial simplification of the folding roller and thus of the folding machine employing it. Also advantages concerning the reduction of the inertia of the suction system are obtained.

Basically, by using the shutters placed inside the cylindrical sleeve, this can be made with a thinner thickness with respect to the traditional rollers. The volume of the empty space in which it must be generated in order to carry out the suction timed with the angular position of the roller is thus very little, this substantially reducing inertia.

The invention claimed is:

1. A folding roller (3) comprising:

a cylindrical sleeve (3C) having a rotation axis (3A), an outer surface (3X) and an inner surface (3Y) delimiting an axial cavity (23) of the cylindrical sleeve (3C);

an inner body (25) axially extending in the axial cavity (23) of the cylindrical sleeve (3C), the cylindrical sleeve (3C) arranged so as to rotate around the inner body (25);

a suction chamber (23A) inside the cylindrical sleeve (3C);

a plurality of suction holes (41, 43) extending from the outer surface (3X) up to the inner surface (3Y) of the cylindrical sleeve (3C); wherein the suction holes are arranged according to longitudinal alignments (42, 44) that are substantially parallel to the rotation axis (3A) of the cylindrical sleeve (3C) and angularly spaced apart with respect to one another;

wherein inside the suction chamber (23A) a plurality of stationary shutters (37) are arranged, spaced from one another along the rotation axis (3A) of the cylindrical sleeve (3C), each shutter (37) having a closing surface (37A) co-acting with the inner surface (3Y) of the cylindrical sleeve (3C) to close selected suction holes (41) of the plurality of suction holes (41, 43), and wherein the plurality of suction holes (41, 43) are subdivided into at least a first longitudinal alignment (42) and a second longitudinal alignment (44), which are angularly spaced apart with respect to one another; and wherein the suction holes (41, 43) are configured and arrangement so that, during rotation of the cylindrical sleeve (3C), the selected suction holes (41) of the first longitudinal alignment (42) are closed by the shutters (37) while remaining suction holes (43) of the second longitudinal alignment (44) are not closed by the shutters (37).

2. The folding roller (3) according to claim 1, wherein the plurality of suction holes (41, 43) are arranged according to annular arrangements around the rotation axis (3A) of the cylindrical sleeve (3C).

3. The folding roller (3) according to claim 1, wherein said plurality of shutters (37) have an adjustable angular development comprised between 55° and 65°.

4. The folding roller (3) according to claim 1, wherein the suction chamber (23A) is delimited by two radial walls (27, 29) integral with the inner body (25) and angularly spaced with respect to each other, and wherein the shutters (37) each extend tangentially from one (29) of said two radial walls inside the suction chamber (23A) towards another (27) of said two radial walls.

5. The folding roller (3) according to claim 1, wherein the suction chamber (23A) has an angular development comprised between 150° and 230°.

6. The folding roller (3) according to claim 1, comprising a plurality of annular grooves (3S) provided on the outer surface (3X) of the cylindrical sleeve (3C), wherein the annular grooves (3S) are interposed between annular alignments of the plurality of suction holes (41, 43).

7. An interfolding machine (1) comprising a pair of folding rollers (3) according to claim 1, arranged with respective rotation axes (3A) substantially parallel to each other and adjacent to each other such as to form a folding nip (5).

8. The interfolding machine (1) according to claim 7, wherein the pair of folding rollers (3) are arranged such that each shutter (37) of one folding roller (3L) of the pair of folding rollers (3) is arranged in front of a space between a pair of consecutive shutters (37) of another (3R) of said pair of folding rollers (3).

9. The interfolding machine (1) according to claim 8, wherein the shutters (37) of the pair of folding rollers (3) extend annularly from the folding nip (5) downstream thereof with respect to a rotation direction (f3) of the pair of folding rollers (3).

10. The interfolding machine (1) according to claim 7, comprising a respective cutting roller (7) for each folding roller (3) of the pair of folding rollers, each cutting roller (7) having a plurality of blades (9) co-acting with at least a respective counter-blade (11) to cut a continuous web material (N1, N2) in sheets (F1-Fn) for folding and interfolding.

11. The interfolding machine (1) according to claim 10, wherein each cutting roller (7) forms, together with a respective folding roller (3), a transfer nip (15), wherein sheets (F1-Fn) cut by the cutting roller (7) are transferred from the respective cutting roller (7) to the corresponding folding roller (3) in the transfer nip (15).

12. The interfolding machine (1) according to claim 11, wherein the suction chamber (23A) of each folding roller (3) extends from the transfer nip (15) towards the folding nip (5) and downstream of said folding nip (5).

13. The interfolding machine (1) according to claim 7, wherein a removing member (17) is associated with each folding roller (3), the removing member configured and arranged to remove sheets (F1-Fn) from a respective folding roller (3).

14. The interfolding machine according to claim 13, wherein the suction chamber (23A) of each folding roller (3) extends downstream of the folding nip (5) up to an area where the removing member (17) operates.

15. A folding roller (3) comprising:

a cylindrical sleeve (3C) having a rotation axis (3A), an outer surface (3X) and an inner surface (3Y) delimiting an axial cavity (23) of the cylindrical sleeve (3C);

an inner body (25) axially extending in the axial cavity (23) of the cylindrical sleeve (3C), the cylindrical sleeve (3C) arranged so as to rotate around the inner body (25);

a suction chamber (23A) inside the cylindrical sleeve (3C);

a plurality of suction holes (41, 43) extending from the outer surface (3X) up to the inner surface (3Y) of the cylindrical sleeve (3C); wherein the suction holes are arranged according to longitudinal alignments (42, 44) that are substantially parallel to the rotation axis (3A) of the cylindrical sleeve (3C) and angularly spaced apart with respect to one another;

wherein inside the suction chamber (23A) a plurality of stationary shutters (37) are arranged, spaced from one another along the rotation axis (3A) of the cylindrical sleeve (3C), each shutter (37) having a closing surface (37A) co-acting with the inner surface (3Y) of the cylindrical sleeve (3C) to close selected suction holes (41) of the plurality of suction holes (41, 43), wherein the plurality of suction holes (41, 43) are subdivided into a plurality of first longitudinal alignments (42) and into a plurality of second longitudinal alignments (44), alternating with, and angularly spaced apart from one another, and wherein the plurality of suction holes (41, 43) are configured and arranged so that, during rotation of the cylindrical sleeve (3C), the selected suction holes (41) of the first longitudinal alignments (42) are closed by the shutters (37) while the remaining suction holes (43) of the second longitudinal alignments (44) are not closed by the shutters (37).

16. The folding roller (3) according to claim 15, wherein the selected suction holes (41) of each first longitudinal alignment (42) are circumferentially aligned with the shutters (37) and are closed by said shutters, while the remaining suction holes (43) of each second longitudinal alignment (44) are displaced with respect to the shutters (37), so that they are not closed by the shutters (37).

17. The folding roller according to claim 15, wherein the inner surface (3Y) of the cylindrical sleeve has, in correspondence of the remaining suction holes (43) of each second longitudinal alignment (44), grooves which prevent the shutters (37) from closing the suction holes (43) of each second longitudinal alignment (44).

18. The folding roller (3) according to claim 15, wherein each longitudinal alignment (42, 44) of suction holes (43, 41) comprises two adjacent lines of suction holes.

* * * * *